US008622502B2

(12) United States Patent
Mizutani et al.

(10) Patent No.: US 8,622,502 B2
(45) Date of Patent: Jan. 7, 2014

(54) INK JET PRINTING APPARATUS AND INK JET PRINTING METHOD

(75) Inventors: Michinari Mizutani, Kawasaki (JP); Torachika Osada, Yamato (JP)

(73) Assignee: Canon Kabushiki Kaisha, Tokyo (JP)

( * ) Notice: Subject to any disclaimer, the term of this patent is extended or adjusted under 35 U.S.C. 154(b) by 925 days.

(21) Appl. No.: 12/331,965

(22) Filed: Dec. 10, 2008

(65) Prior Publication Data

US 2009/0153606 A1 Jun. 18, 2009

(30) Foreign Application Priority Data

Dec. 13, 2007 (JP) ..... 2007-322574

(51) Int. Cl.
*B41J 2/205* (2006.01)

(52) U.S. Cl.
USPC ..... 347/15; 347/9; 347/40; 347/41

(58) Field of Classification Search
None
See application file for complete search history.

(56) References Cited

U.S. PATENT DOCUMENTS 4,528,576 A * 7/1985 Koumura et al. ..... 347/15
5,173,717 A 12/1992 Kishida et al.
5,889,537 A * 3/1999 Shimada ..... 347/41
6,966,621 B2 * 11/2005 Takahashi et al. ..... 347/12
7,290,854 B2 11/2007 Mizutani et al.
2004/0070638 A1 4/2004 Takahashi et al.
2007/0002096 A1 1/2007 Teshigawara et al.
2008/0145068 A1 6/2008 Mizutani

FOREIGN PATENT DOCUMENTS

JP 58-179653 10/1983
JP 2004-142452 A 5/2004
JP 2005-186610 7/2005
JP 2006-021532 A 1/2006

OTHER PUBLICATIONS

Office Action Japanese Patent Appln. No. 2008-315838 mailed Jan. 29, 2013, Japanese Patent Office.

* cited by examiner

*Primary Examiner* — Uyen Chau N Le
*Assistant Examiner* — Chad Smith
(74) *Attorney, Agent, or Firm* — Fitzpatrick, Cella, Harper & Scinto

(57) ABSTRACT

An adverse effect of air flows occurring near the nozzle line with high print duty is reliably avoided by appropriately dividing and allocating the print data to a plurality of ink ejection nozzle lines. When the print head is scanning in a forward direction, a combination of a magenta ink nozzle line and a yellow ink nozzle line that do not adjoin each other is mainly used. When the print head is scanning in a backward direction, another combination of a magenta ink nozzle line and a yellow ink nozzle line that do not adjoin each other is mainly used.

19 Claims, 27 Drawing Sheets

X1(FORWARD DIRECTION)

X2(BACKWARD DIRECTION)

X1 (FORWARD DIRECTION)

X2 (BACKWARD DIRECTION)

X1 (FORWARD DIRECTION)

X2 (BACKWARD DIRECTION)

| | DATA ALLOCATION RATIO FOR CYAN INK (C1: C2) | | DATA ALLOCATION RATIO FOR MAGENTA INK (M1: M2) | | DATA ALLOCATION RATIO FOR YELLOW INK (Y1: Y2) | |
|---|---|---|---|---|---|---|
| GRAYSCALE LEVEL | FORWARD DIRECTION | BACKWARD DIRECTION | FORWARD DIRECTION | BACKWARD DIRECTION | FORWARD DIRECTION | BACKWARD DIRECTION |
| 0~64 | 1 : 1 | 1 : 1 | 1 : 1 | 1 : 1 | 1 : 1 | 1 : 1 |
| 65~192 | 2 : 1 | 1 : 2 | 1 : 3 | 3 : 1 | 4 : 1 | 1 : 4 |
| 193~255 | 2 : 1 | 1 : 2 | 1 : 3 | 3 : 1 | 4 : 1 | 1 : 4 |

FIG.23

| INDEX A | |
|---|---|
| LEVEL | DOT ARRANGEMENT PATTERN |
| 0 | 0A<br>EVEN<br>ODD |
| 1 | 1B<br>EVEN<br>ODD |
| 2 | 2C<br>EVEN<br>ODD |

FIG.25A

| INDEX B | |
|---|---|
| LEVEL | DOT ARRANGEMENT PATTERN |
| 0 | 0A<br>EVEN<br>ODD |
| 1 | 1A<br>EVEN<br>ODD |
| 2 | 2A<br>EVEN<br>ODD |

FIG.25B

| INDEX C | |
|---|---|
| LEVEL | DOT ARRANGEMENT PATTERN |
| 0 | 0A<br>EVEN<br>ODD |
| 1 | 1A 1B<br>EVEN<br>ODD |
| 2 | 2B<br>EVEN<br>ODD |

FIG.25C

INK JET PRINTING APPARATUS AND INK JET PRINTING METHOD

BACKGROUND OF THE INVENTION

1. Field of the Invention

The present invention relates to an ink jet printing apparatus and an ink jet printing method that print images using a print head capable of ejecting ink from a plurality of nozzle lines.

2. Description of the Related Art

In printing apparatus, particularly those using an ink jet print head capable of ejecting ink (ink jet printing apparatus), improvements in a printing speed during color image printing and in a printed image quality have become an important subject.

In a so-called serial scan type printing apparatus, commonly used methods for improving the printing speed include increasing a drive frequency of the print head (ink ejection frequency) and adopting a bidirectional printing system. The bidirectional printing system performs a printing scan while the print head is moving in both a forward and a backward direction. In the serial scan type printing apparatus, images are formed on a print medium successively by repetitively executing a printing scan of the print head in a main scan direction and a print medium transport operation in a subscan direction. The bidirectional printing system as a total system has a cost advantage over a one-way printing system that executes the printing scan as the print head moves only in one of the forward and backward directions because the bidirectional printing system can distribute an energy required to get the same throughput over a period of time.

In the bidirectional printing system, however, when a color image is formed by ejecting a plurality of color inks from the print heads, an order of ejecting color inks onto a print medium during the forward movement of the print head differs from that during the backward movement of the print head, giving rise to a possibility that bands of color variations may show on a printed image. Since such color variations are caused by different color ink ejection orders between the forward and backward scans of the print heads, even a slight overlapping of different color ink dots that may occur on a print medium can result in color variations to some degree.

To prevent color variations caused by the color ink ejection order difference, Japanese Patent Laid-Open No. S58-179653 (1983) discloses a print head provided with forward scan nozzles and backward scan nozzles for the same color ink. These two groups of nozzles are selectively used according to the direction of movement of the print head so that the color ink ejection order remains the same in whatever direction the print head is moving. The print head is constructed to eject, for example, Y (yellow), M (magenta), C (cyan) and Bk (black) inks.

When an ink droplet is ejected from a nozzle in response to a print signal, very fine ink droplets may also be ejected trailing a main ink droplet. Also when a main ink droplet lands on a print medium, it may bounce back from the print medium, giving rise to a possibility of very minute ink droplets being formed in a space between the print head and the print medium. Such minute ink droplets (referred to also as "ink mist"), when formed, may adhere to an ejection face of the print head (the surface of the print head formed with ejection openings), forming drops of ink on the print head. These ink drops may make the ejection of ink droplets from ejection openings unstable or cause ink ejection failures.

One method for minimizing the formation of such ink drops is by applying a water-repellent finishing to the ejection face of the print head to form a water-repellent film over the entire ejection face. In a print head with the water-repellent film, the amount of ink accumulating around the ejection openings decreases. However, where two or more nozzle lines ejecting different color inks are driven simultaneously to operate the print head at high drive frequency continuously for a long period and at high speed to form an image with high print duty, the amount of ink mist produced increases. As a result, ink drops may gradually accumulate on the ejection face of the print head.

The relation between ink mist adhering to the ejection face of the print head and an ink ejection state will be explained in the following.

As described in Japanese Patent Laid-Open No. S58-179653 (1983), color variations that may occur during a bidirectional printing can be minimized by selectively using the forward scan nozzle line and the backward scan nozzle line so that the color ink ejection order remains unchanged in whichever of the forward and backward direction the print head executes the printing scan. In the print head the forward scan nozzle line and the backward scan nozzle line are arranged symmetrically for each of different color inks.

FIG. 19 shows how an image of secondary color is formed on a print medium P by ejecting different ink droplets 11, 12 from ejection openings N1, N2 of two adjoining nozzle lines L1, L2 during the forward and backward printing scans moving in the directions of arrow X1, X2. During the forward printing scan, two of a plurality of nozzle lines forming the forward scan nozzles are used; and during the backward printing scan two of a plurality of nozzle lines forming the backward scan nozzles are used. In this example, the nozzle lines L1, L2 are formed in different chips. As the ink droplets I1, I2 are ejected from the ejection openings N1, N2 at high frequency and fly through air, nearby viscous air is pulled by the ink droplets, with the result that the proximity of the ejection face of the print head tends to be depressurized compared with the proximity of the print medium P. This causes surrounding air to flow toward the depressurized region as indicated by arrows in the figure. This air flow has been found to draw minute ink droplets, smaller than the ink droplets I1, I2 (main droplets), toward the print head. These minute ink droplets include satellites (not shown) accompanying the ink droplets I1, I2 as they are ejected and mist formed by the ink droplets I1, I2 bouncing back when they land on the print medium P.

FIGS. 20A, 20B, 21A, 21B, 22A and 22B show in such a phenomenon how mist adheres to the ejection face of the print head when a high-duty image is formed by a plurality of printing scans with a large volume of ink applied to a unit print area. In these figures, C1 and C2 denote nozzle lines for a cyan ink, M1 and M2 nozzle lines for a magenta ink, and Y1 and Y2 nozzle lines for yellow ink. Distances L between adjoining nozzle lines are 1 mm.

FIGS. 20A and 20B shows states of mist 12 formed on the ejection face of the print head when the nozzle lines C1, M2 are driven during a forward scan and the nozzle lines C2, M1 are driven during a backward scan to print a secondary color. A distance L between the simultaneously driven nozzles is 4 mm. FIGS. 21A and 21B shows states of mist 12 formed on the ejection face when the nozzle lines C1, Y1 are driven during a forward scan and the nozzle lines C2, Y2 are driven during a backward scan to print a secondary color. A distance L between the simultaneously driven nozzles is 2 mm. FIGS. 22A and 22B shows states of mist 12 formed on the ejection face when the nozzle lines C1, M1 are driven during a forward scan and the nozzle lines C2, M2 are driven during a backward scan to print a secondary color. A distance L between the simultaneously driven nozzles is 1 mm.

SUMMARY OF THE INVENTION

Studies by the inventors of this invention have produced the following findings.

There is a correlation between the distance L between simultaneously driven nozzle lines and the amount of mist adhering the ejection face of a print head. It is found that as the distance L increases, the amount of mist adhering to the ejection face decreases. Particularly where the distance L between the simultaneously driven nozzle lines is short, there tends to be a greater depressurization than when the distance L is longer, because ink droplets ejected at high frequency falls onto a very narrow print area between the nozzle lines. This makes it more likely for satellites and bouncing mist to reach the print head.

The research conducted by the inventors has found that when a water-repellent finish is applied to an almost entire surface of the ejection face of a print head, ink mist tends to adhere in greater amount to areas remote from the ejection openings. For example, in areas about 500 μm to 1 mm from the ejection openings there are many large aggregates of ink mist grown to between 300 μm and 500 μm in diameter. The water-repellent area has a large contact angle with a liquid (link) and therefore a large fluidity. When its contact angle with ink exceeds 80 degrees, this tendency becomes more conspicuous. Thus, the ink mist aggregates grown to a large size become easily movable by an inertia of the print head during its reciprocal movement or by its own weight and may reach the ejection openings. An ink mist, when drawn into one or more ejection openings, may cause ink ejection failures. Particularly when a bubble-through type print head capable of ejecting small-volume ink droplets of 10 picoliters or less at high frequency in one ejection operation is used, with its nozzle line interval set narrow, the possibility of ejection failure increases dramatically.

One possible method for removing ink mist may involve increasing the frequency of cleaning the ejection face of the print head. For example, the cleaning may be done frequently each time one line, rather than one page, of image is printed. However, increasing the cleaning frequency can result in a reduction in the printing speed.

To deal with this problem Japanese Patent Laid-Open No. 2005-186610 describes a method which, in a multi-pass printing system using a print head formed with a plurality of nozzle lines, reduces influences of air flows that occur when high print duty nozzle lines are put side by side. Japanese Patent Laid-Open No. 2005-186610 discloses a nozzle line arrangement for each ink color that comprises an array of nozzles (odd-numbered nozzle line) to print odd-numbered columns of dots and an array of nozzles (even-numbered nozzle line) to print even-numbered columns of dots. The odd- and even-numbered nozzle lines are placed side by side. For example, in a first pass, print data smaller in volume than that of second pass is equally allocated to the odd- and even-numbered nozzle lines. In a second pass, print data greater in volume than that of the first pass is equally allocated to the odd- and even numbered nozzle lines.

That is, in Japanese Patent Laid-Open No. 2005-186610, the two nozzle lines (odd- and even-numbered nozzle lines) of each ink color are set to have equally allocated print data in each printing scan. Because of this print data assignment relationship, there is limitation on how the print data is allocated.

This invention provides an ink jet printing apparatus and a printing method that can optimally allocate print data to a plurality of ink ejecting nozzle lines to reduce influences of air flows occurring near high print duty nozzle lines.

In a first aspect of the present invention, there is provided an ink jet printing apparatus to print an image by moving a print head in a main scan direction, wherein the print head has a plurality of nozzle lines capable of ejecting ink, the plurality of nozzle lines are arrayed side by side, and the main scan direction crosses a longitudinal direction of each nozzle line, the ink jet printing apparatus comprising: allocation unit that allocates multivalued data representing gradation values corresponding to the number of dots to be printed in one pixel to the plurality of nozzle lines at different data allocation ratios; and control unit that ejects the ink from the print head according to the multivalued data allocated by the allocation unit, wherein the allocation unit sets the data allocation ratios for the plurality of nozzle lines to different ratios so that the nozzle lines with high data allocation ratio do not concentrate in position in the main scan direction.

In a second aspect of the present invention, there is provided an ink jet printing apparatus to print an image by moving a print head in a main scan direction, wherein the print head has a plurality of nozzle lines capable of ejecting ink, the plurality of nozzle lines are arrayed side by side, and the main scan direction crosses a longitudinal direction of each nozzle line, the ink jet printing apparatus comprising: allocation unit that allocates print data representing a dot print action or a non-print action to each of the plurality of nozzle lines at different data allocation ratios; and control unit that ejects the ink from the print head according to the multivalued data allocated by the allocation unit, wherein the allocation unit sets the data allocation ratios for the plurality of nozzle lines to different ratios so that the nozzle lines with high data allocation ratio do not concentrate in position in the main scan direction.

In a third aspect of the present invention, there is provide an ink jet printing method to print an image by moving a print head in a main scan direction, wherein the print head has a plurality of nozzle lines capable of ejecting ink, the plurality of nozzle lines are arrayed side by side, and the main scan direction crosses a longitudinal direction of each nozzle line, the ink jet printing method comprising: an allocation step to allocate multivalued data representing gradation values corresponding to the number of dots to be printed in one pixel to the plurality of nozzle lines at different data allocation ratios; and a control step to eject the ink from the print head according to the multivalued data allocated by the allocation step, wherein the allocation step sets the data allocation ratios for the plurality of nozzle lines to different ratios so that the nozzle lines with high data allocation ratio do not concentrate in position in the main scan direction.

In distributing ink ejection data among a plurality of nozzle lines, this invention changes a data allocation ratio between the nozzle lines according to the nozzle line positions. This can prevent the nozzle lines with high allocation ratio from being concentrated and thereby reduce influences of air flows that occur near high print duty nozzle lines. As a result, the amount of ink mist adhering to the print head can be reduced even when the nozzle line density or pitch is high or ink ejection frequency is high, thus minimizing ink ejection failures that would otherwise be caused by the ink mist clogging the nozzles.

Further features of the present invention will become apparent from the following description of exemplary embodiments (with reference to the attached drawings).

BRIEF DESCRIPTION OF THE DRAWINGS

FIG. 23 shows one example of data allocation ratio in the first embodiment of this invention;

FIG. 25A, FIG. 25B and FIG. 25C show indexes used in an index development unit of FIG. 24.

DESCRIPTION OF THE EMBODIMENTS

Embodiments of this invention will be described by referring to the accompanying drawings.

First Embodiment

Figure 1:
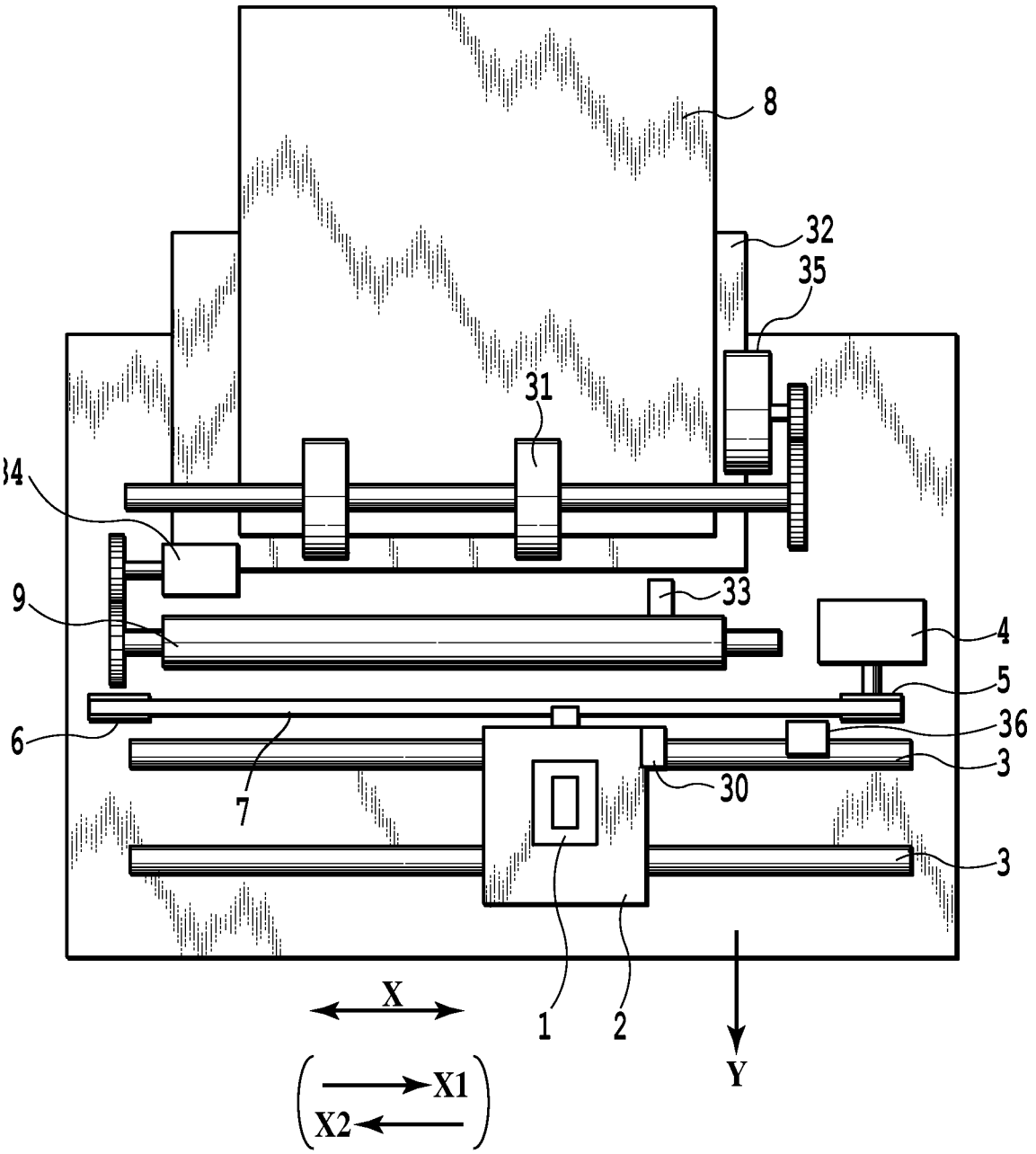
FIG. 1 is a schematic view showing an outline configuration of an ink jet printing apparatus in a first embodiment of this invention.

FIG. 1 shows a construction of main components of the ink jet printing apparatus applicable to the present invention.

In FIG. 1, a head cartridge 1 is replaceably mounted on a carriage 2. The head cartridge 1 has a print head and an ink tank separably or integrally incorporated therein and also has a connector (not shown) for receiving and transmitting print head drive signals. The carriage 2 is provided with a connector holder (electric connecting unit) to transmit drive signals to the head cartridge 1 through the connector.

The print head in the head cartridge 1 has a heater (electrothermal converter) as a means of generating an energy to eject ink. The thermal energy of the heater causes a film boiling in ink, producing a bubble that in turn expels an ink droplet from an ink ejection opening. In a system that uses a bubble formed in ink by the heat of the heater to eject ink droplets, a bubble-through method may be adopted which communicates the bubble growing in ink to the open air through the ejection opening. As to the ink ejection method, various methods are available, such as one using a piezoelectric element as the ejection energy generation means, as well as the heater type. Ink droplets ejected from ejection openings may be set smaller than 10 picoliters. A structure consisting of the ejection energy generation means and the ejection opening may also be called a "nozzle".

The carriage 2 is supported reciprocally movable on guide shafts 3 extending in a main scan direction represented by an arrow X. The carriage 2 is driven by a main scan motor 4 through a drive mechanism including a motor pulley 5, a follower pulley 6 and a timing belt 7, and its moving position and speed are controlled. The carriage 2 is provided with a home position sensor 30, the moving position of the carriage 2 can be detected by using as a reference a moving position at which the home position sensor detects a shield plate 36 installed at a predetermined position in the printing apparatus.

A print medium 8, such as print paper and plastic thin sheet, is fed one sheet at a time from an auto sheet feeder (ASF) 32 by a paper supply motor 35 rotating a pickup roller 31 through gears. The print medium 8 is further fed by a transport roller 9 in a subscan direction of arrow Y to pass over a printing position facing an ejection face (ejection opening formation surface) of the print head. The subscan direction crosses the main scan direction (in this case, at right angles). The transport roller 9 is rotated by a subscan motor 34 through gears. A check on whether the print medium 8 has been fed and a determination of the head position of the print medium 8 are done by using as a reference the instant when the print medium 8 has passed a paper end sensor 33. The paper end sensor 33 is also used to determine the rear end position of the print medium 8 and the current printing position from the rear end of the print medium 8.

The print medium 8 is supported at its back on a platen (not shown) so that it forms a flat print surface at the printing position. The head cartridge 1 mounted on the carriage 2 is supported so that an ejection face of the print head protruding down from the carriage 2 is parallel with the print medium 8 between the two guide shafts 3.

Figure 2A:
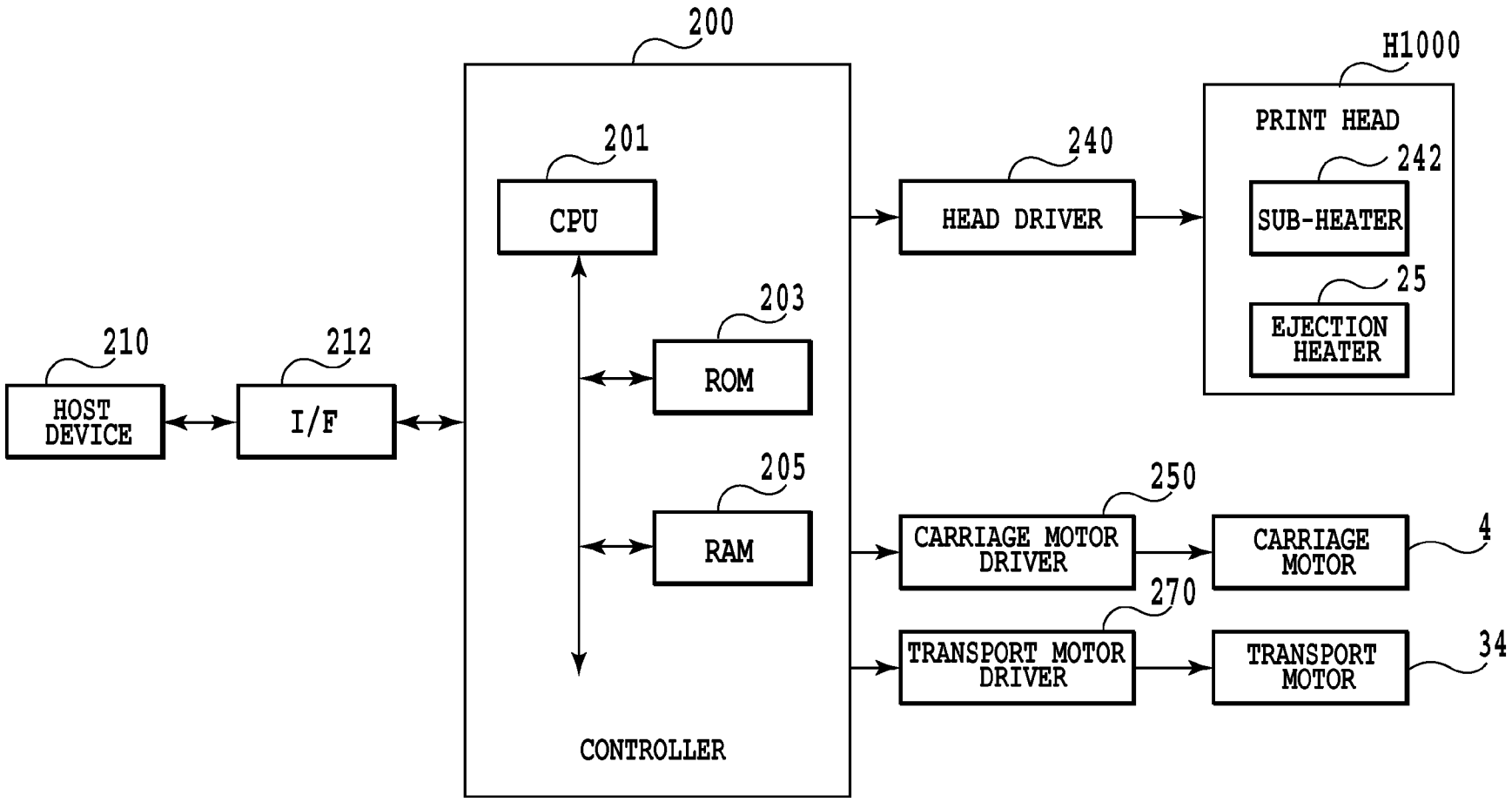
FIG. 2A is a block configuration diagram of a control system in the ink jet printing apparatus of FIG. 1.

FIG. 2A is a block diagram showing a control configuration in the printing apparatus. Denoted 200 is a controller that performs an overall control of the entire apparatus by retrieving information from various units in the apparatus and sending commands. The controller 200 has, in addition to a CPU 201, a ROM 203 in which to store a variety of programs, and a RAM 205 used as a work area for the CPU 201 and as a buffer area to store pre-print data for each ink color. The ROM 203 also stores tables and fixed data necessary for print control, in addition to the above programs.

A host device 210 externally connected to the printing apparatus is an image data supply source and may for example be a computer for generating and processing image data to be printed or an image reader. The image data, other commands and status signals are transferred between the host device 210 and the controller 200 through an interface (I/F) 212. The image data transferred from the host device 210 to the controller 200 is a 600-ppi (pixels/inch; reference value) multivalued signal while the image data that the print head H1000 prints on the print medium is a 200-dpi binary signal. That is, in performing the print operation, the controller 200 converts the 600-ppi multivalued signal into the 1200-dpi binary signal. This conversion operation will be detailed later.

A head driver 240 drives electrothermal converters (ejection heaters) 25 of the print head H1000 according to the binary print data. The print head H1000 also has a subheater 242 to heat the print head to an appropriate temperature.

A carriage motor driver 250 drives the carriage motor 4 to move the carriage 2. A transport motor driver 270 drives the paper feed motor 34 to feed the print medium in a subscan direction.

Figure 2B:
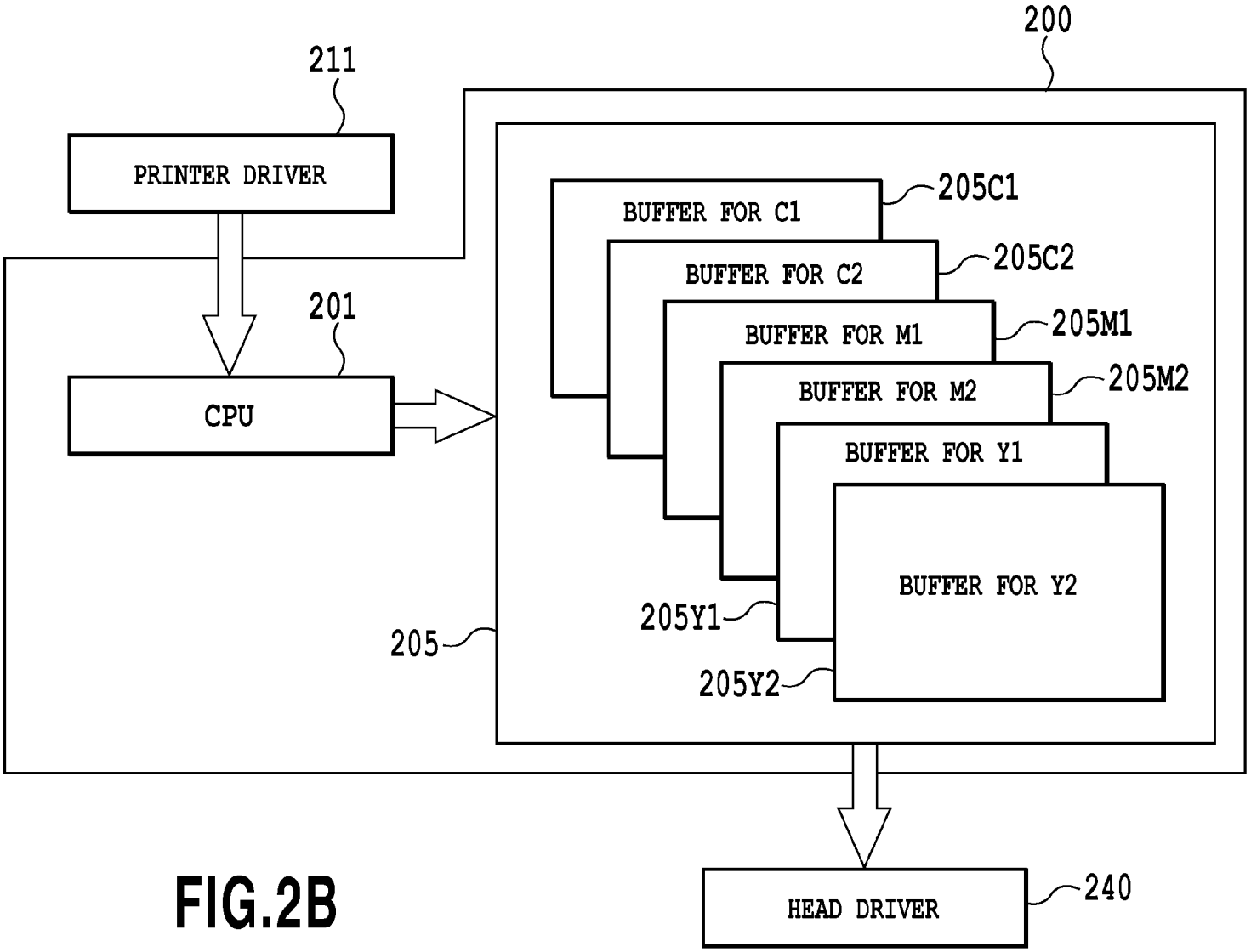
FIG. 2B shows buffers in a RAM of FIG. 2A.
Figure 2C:
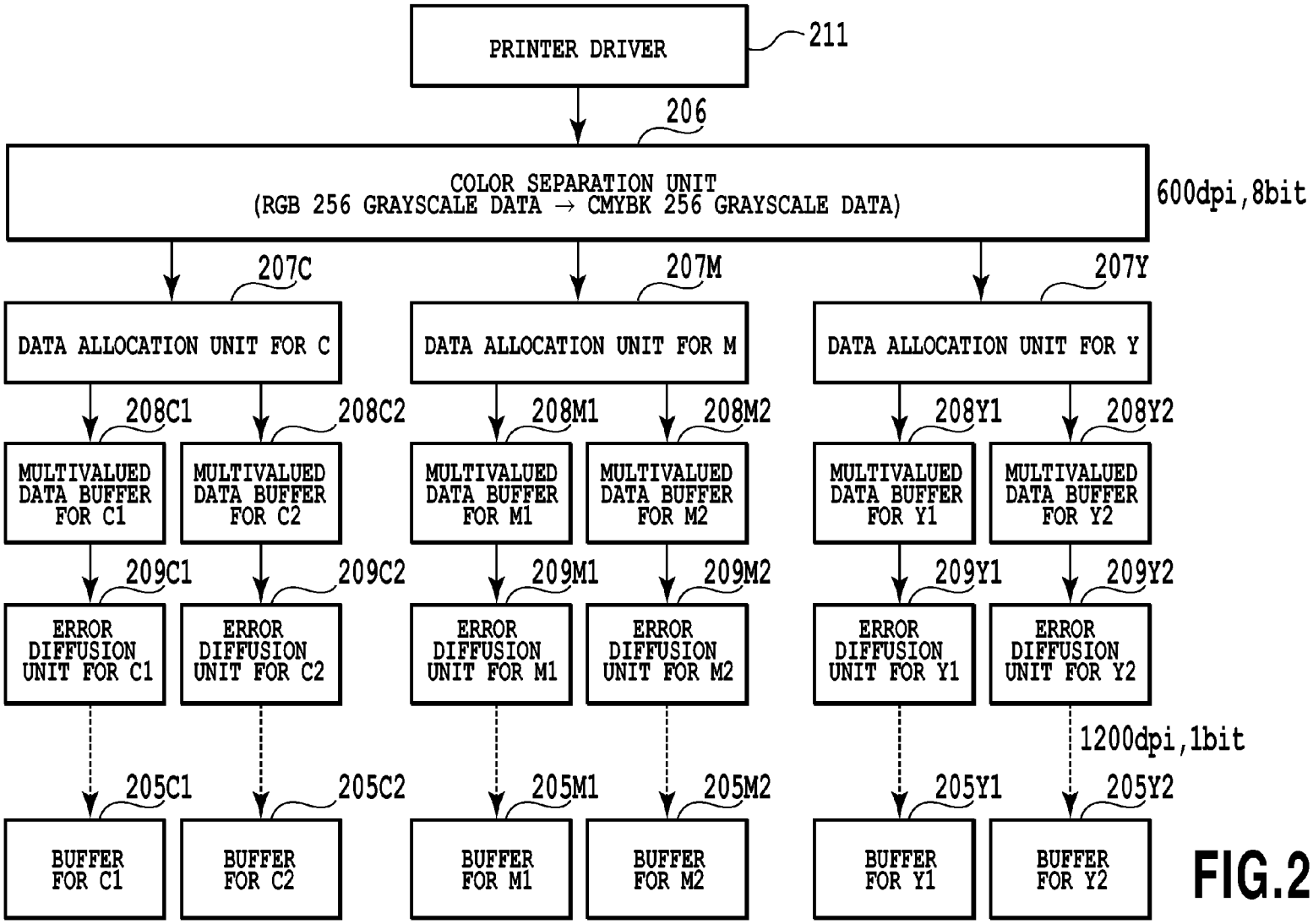
FIG. 2C is a block diagram showing functions of a CPU of FIG. 2A.
Figure 3A:
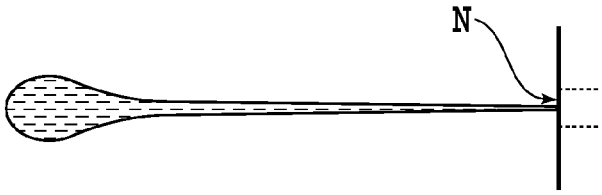
FIGS. 3A, 3B, 3C and 3D show states of ink at different stages of being ejected from an ink jet print head.
Figure 3B:
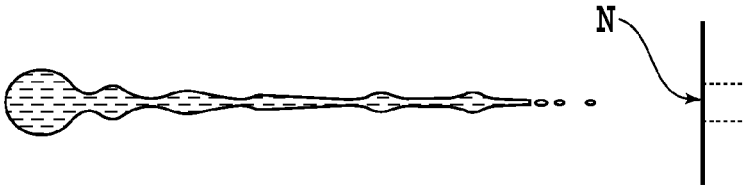
Figure 3C:
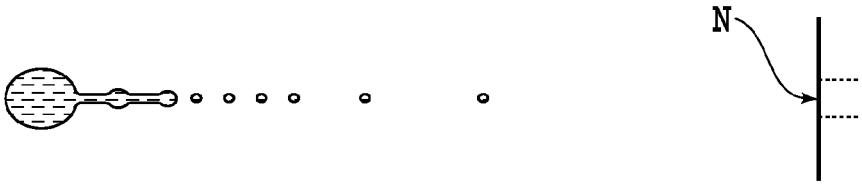
Figure 3D:
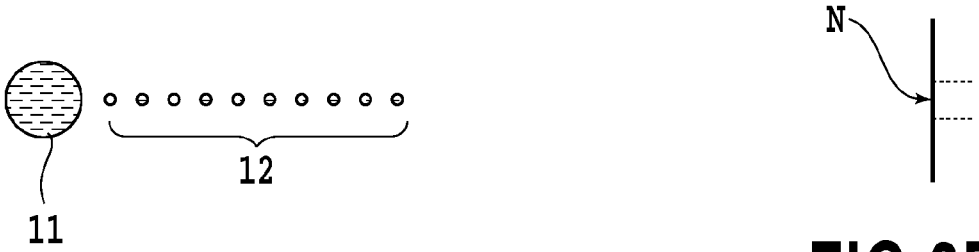

FIG. 2B shows a configuration of a data buffer 205 for each ink color under the control of the CPU 201 of the controller 200. FIG. 2C is a schematic diagram showing a sequence of image processing executed by the CPU 201. In this example, as described later, cyan ink nozzle lines include two nozzle lines C1, C2; magenta ink nozzle lines include two nozzle lines M1, M2; and yellow ink nozzle lines include two nozzle lines Y1, Y2. These nozzle lines C1, C2, M1, M2, Y1, Y2 are arranged along the main scan direction with each nozzle line laid lengthwise in a direction crossing the main scan direction, as described later. Reference numbers 205C1, 205C2, 205M1, 205M2, 205Y1, 205Y2 are buffers corresponding to the nozzle lines C1, C2, M1, M2, Y1, Y2.

As shown in FIG. 2B, the printer driver 211 is software installed in the host device 210 and supplies desired image data as the 600-ppi (pixels/inch) multivalued brightness data for red (R), green (G) and blue (B) to the controller 200.

As Next, referring to FIG. 2C, the CPU 201 in the controller 200 that has received the multivalued brightness data RGB performs a color separation process in a color separation unit 206 and converts these data into multivalued gradation data CMY for each ink color used in the printing apparatus. Further, the CPU 201 performs a data allocation process in allocation units 207C, 207M, 207Y to allocate multivalued gradation data (also referred to simply as "multivalued data") for cyan (C), magenta (M) and yellow (Y) to the two nozzle lines for each color.

FIG. 23 shows an example of data allocation ratios between the two nozzle lines (C1 and C2; M1 and M2; Y1 and Y2) for each color in the data allocation process. A vertical axis represents multivalued gradation data value (gradation value), which roughly corresponds to the number of ink ejections in each pixel. In this example, gradation data is 8-bit 256-level gradation data. A gradation level range 0-64 corresponds to a print density obtained when no ink droplet is ejected to a 600-dpi pixel. A gradation level range 65-192 corresponds to a print density in which one ink dot is formed in a 600-dpi pixel. A gradation level range 193-255 corresponds to a print density in which two ink dots are formed in a 600-dpi pixel. Such an allocation ratio table is stored in the ROM 203 of the controller 200 in advance. The CPU 201 detects multivalued data (image gradation) values for all pixels in an image area and, according to the detected value and the printing scan direction (forward or backward direction) in which the pixel of interest is being printed, references the above table to determine a data allocation ratio for each nozzle line.

For example, when the cyan ink multivalued data (gradation level) value for a pixel of interest is 120, the CPU 201 divides the multivalued data of the pixel at a ratio of 1:2. When the pixel of interest is printed in the forward scan, a gradation data value of 80 (=120×2/3) is put in the multivalued data buffer 208C1 corresponding to the nozzle line C1 situated at the front in the scan direction. In the multivalued data buffer 208C2 corresponding to the nozzle line C2 situated at the rear in the scan direction, a gradation data value of 40 (=120×1/3) is placed. When on the other hand the pixel of interest is printed in the backward scan, a data value of 40 (=120×1/3) is entered into the multivalued data buffer 208C1 corresponding to the nozzle line C1 and a data value of 80 (=120×2/3) is entered into the multivalued data buffer 208C2 corresponding to the nozzle line C2.

Returning to FIG. 2B and FIG. 2C, when the multivalued data has been written into the multivalued data buffers 208C1, 208C2, 208M1, 208M2, 208Y1, 208Y2, the CPU 201 performs an error diffusion process on these multivalued data. That is, the CPU 201 performs the error diffusion process on individual multivalued data stored in the multivalued data buffers for the nozzle lines by using error diffusion units 209C1, 209C2, 209M1, 209M2, 209Y1, 209Y2 and converts them to binary data. Then, individual binary data is stored in buffers 205C1, 205C2, 205M1, 205M2, 205Y1, 205Y2. In this example, these binary data is 1200-dpi 1-bit signal. The binary data stored in the buffers is transferred by the CPU 201 to the head driver 240 for each printing scan. Then, based on the binary data, the ejection heaters as ejection energy generation means are driven to execute the ink ejection operation in each printing scan.

FIGS. 3A to 3D explain how an ink droplet ejected from a nozzle N of the print head changes in shape over time. The ink droplet ejected from the nozzle N splits into a main droplet 11 and a plurality of minute satellites 12 as time elapses.

Figure 4:
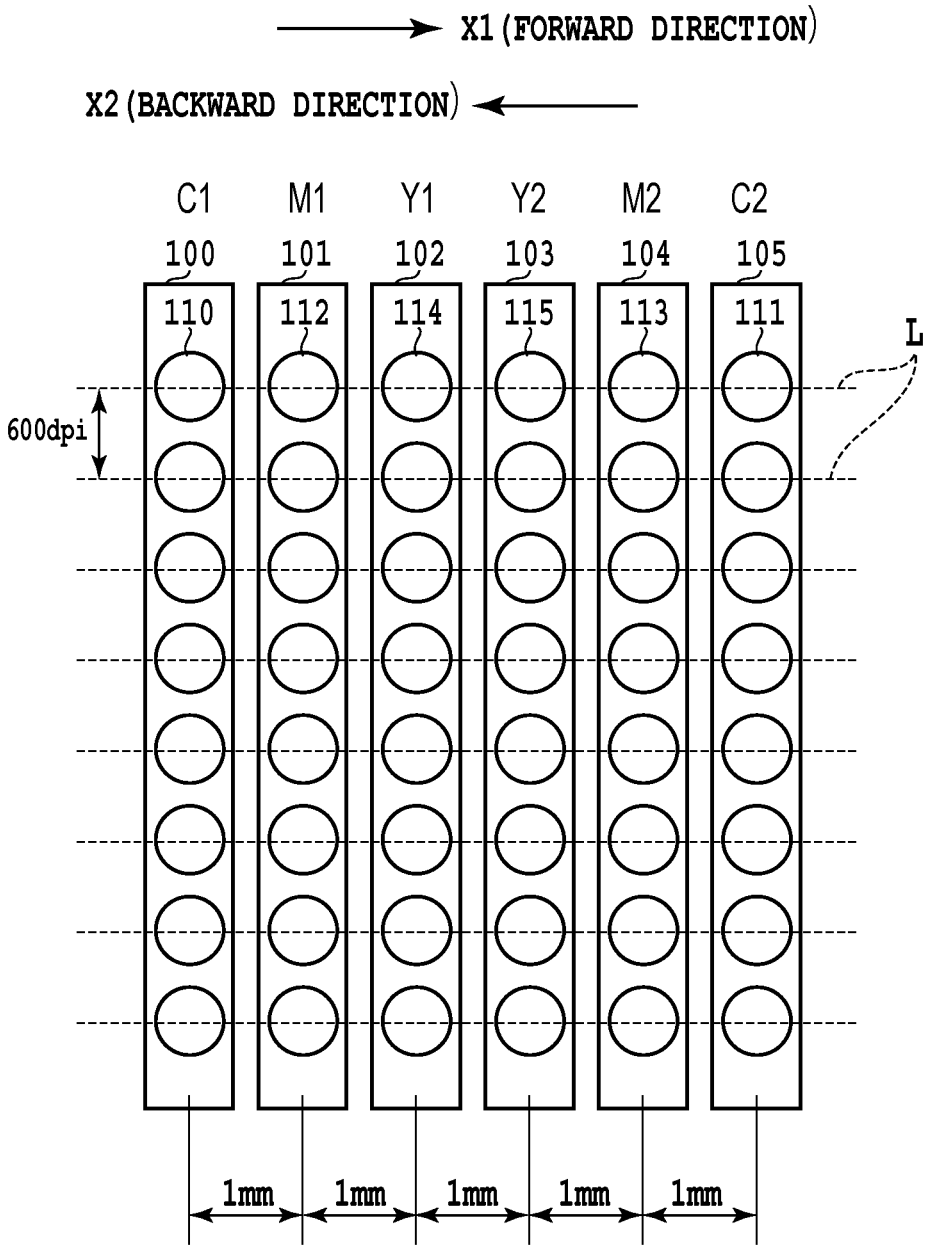
FIG. 4 is a schematic diagram showing a nozzle configuration of the ink jet print head used in the first embodiment of this invention.

FIG. 4 is a schematic diagram showing the structure of the print head in the head cartridge 1. In the figure, reference number 100 represents a first nozzle line for ejecting a cyan ink (C) (also referred to as a "nozzle line C1"). Reference number 101 represents a first nozzle line for ejecting a magenta ink (M) (also referred to as a "nozzle line M1"). Reference number 102 represents a first nozzle line for ejecting a yellow ink (Y) (also referred to as a "nozzle line Y1"). Reference number 103 represents a second nozzle line for ejecting a yellow ink (Y) (also referred to as a "nozzle line Y2"). Reference number 104 represents a second nozzle line for ejecting a magenta ink (M) (also referred to as a "nozzle line M2"). Reference number 105 represents a second nozzle line for ejecting a cyan ink (C) (also referred to as a "nozzle line C2"). Another nozzle line for ejecting a black ink (Bk) may also be added. These nozzle lines may be formed in the same print head or in separate print heads.

Designated 110 are nozzles in the nozzle line C1 for ejecting a cyan ink. Designated 111 are nozzles in the nozzle line C2 for ejecting a cyan ink. Denoted 112 are nozzles in the nozzle line M1 for ejecting a magenta ink. Denoted 113 are nozzles in the nozzle line M2 for ejecting a magenta ink. Denoted 114 are nozzles in the nozzle line Y1 for ejecting a yellow ink. Denoted 115 are nozzles in the nozzle line Y2 for ejecting a yellow ink.

Nozzles in each of the nozzle lines are arrayed in a direction crossing (in this example, at right angles to) the main scan direction. These nozzles may be arrayed somewhat at an angle to the main scan direction according to the ejection timing. The nozzle lines are arranged side by side in the main scan direction at an interval of 1 mm.

In this example, each of the nozzle lines has 256 nozzles arrayed at a pitch of 600 dpi, and ejects an ink volume of 5 pl from each nozzle for a print resolution of 1200 dpi in the scan direction. In FIG. 4 only eight nozzles are shown representatively. A carriage scan speed is 25 inches/sec and a print head drive frequency (ink droplet ejection frequency) is 15 kHz. Horizontal broken lines L in FIG. 4 are main scan lines, or lines of pixels or raster of an image.

In this example, the amount of ink applied to a unit print area, i.e., a print duty, is an ink volume applied to unit print areas printed by one scan of the print head (also referred to as a "one-scan print area"). Such a print duty can be calculated based on print data for each ink—cyan, magenta and yellow. For example, the number of dots formed (ink droplets ejected) is counted in each of a plurality of unit areas making up a one-scan print area and the printed dot count values in unit areas are summed up to determine a total number of dots printed in each scan. Then, a percentage of the total number of dots actually formed with respect to the number of dots that can be formed in the one-scan print area can be defined as a print duty. For example, a unit area may be defined as an area equivalent to 600×600 dpi (42.3 μm×42.3 μm) in which two dots may be formed. In that case, when two dots are formed in all unit areas of the one-scan print area, the print duty is 100% for the ink forming these dots.

During a 1-pass printing, such a print duty is used as is. During a 2-pass printing, one-half the print duty of 1-pass printing is used as the print duty. That is, in a multipass print mode in which an image in a predetermined area is printed in two or more (N) scans, a print duty per scan during an N-pass printing is 1/N the print duty of 1-pass printing.

In this embodiment, by considering the positional relation among the nozzle lines C1, M1, Y1, Y2, M2, C2, multivalued data corresponding to cyan, magenta and yellow ink is allocated to the individual nozzle lines according the allocation table of FIG. 23. In this embodiment, considering the fact that ink mist is more likely to adhere to the print head by increasing the influences of air flows as the paired nozzle lines are closer, the allocation ratio is so set that a difference between the divided data values progressively increases in the order of cyan, magenta and yellow. It is noted, however, that this invention is not limited to this method and that the allocation ratios for all colors may be equal.

Figure 5:
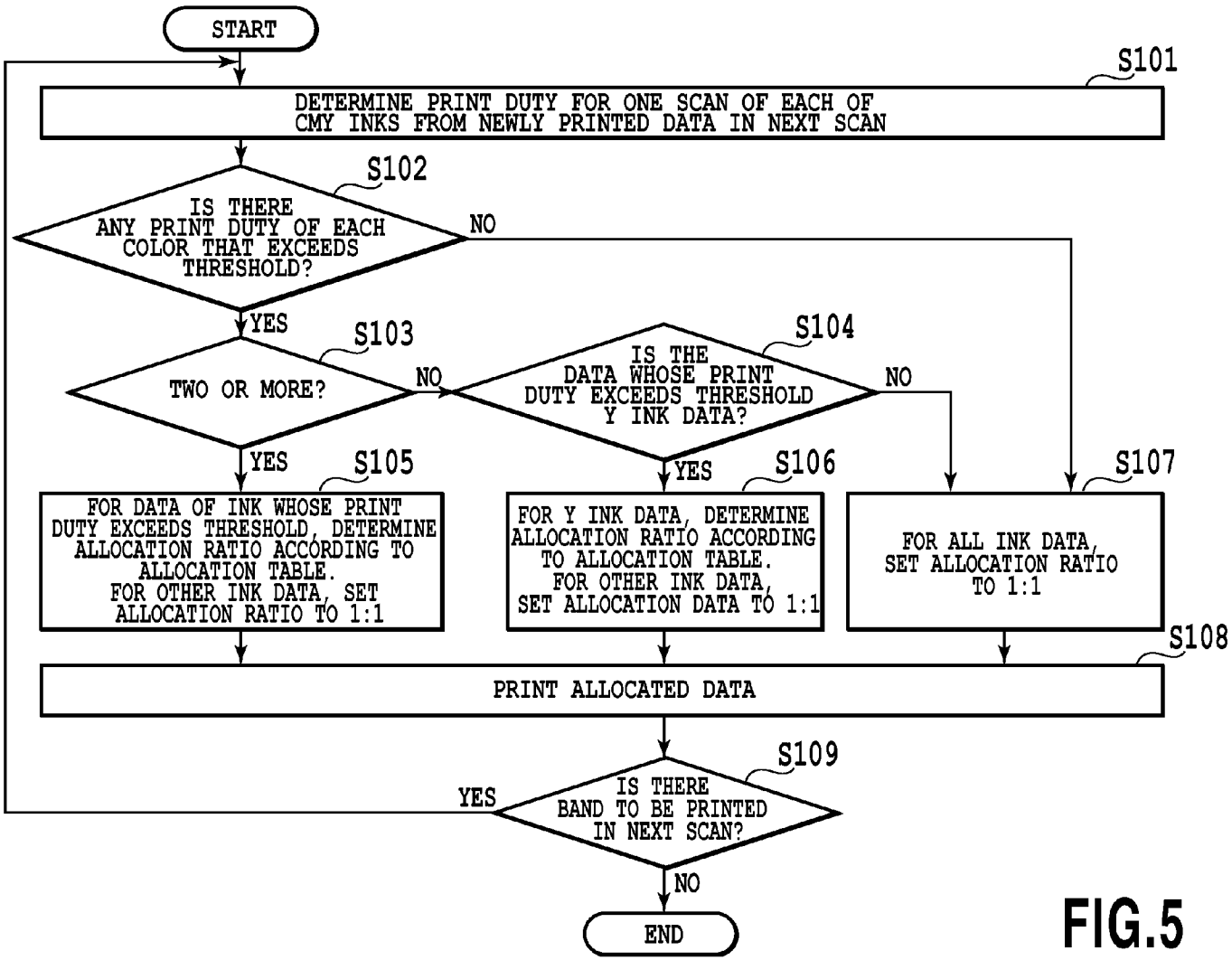
FIG. 5 is a flow chart showing image data allocation process in the first embodiment of this invention.

FIG. 5 is a flow chart explaining the allocation of multivalued data.

First, based on data to be printed in the next scan, print duties DC, DM, DY for cyan, magenta and yellow inks are calculated (S101). Next, a check is made to see if there is any of the calculated print duties for three colors that exceeds a predetermined threshold (S102).

If the result of step S102 is "yes", another check is made to see if the number of print duties in excess of the predetermined threshold is two or more (S103). Then, if the step S103 decides that there are two or more of them, the processing proceeds to step S105 where it allocates according to the allocation table of FIG. 23 the multivalued data for the print duties that exceed the predetermined threshold. For example, when the print duties of cyan and magenta ink are in excess of the predetermined threshold, the cyan multivalued data is divided and allocated to the nozzle lines C1, C2 at a ratio of 2:1 or 1:2 for pixels whose data values are more than 65. But for pixels whose data values are lower than 65, the data value is divided and allocated to the nozzle lines C1, C2 at a ratio of 1:1 because the influence of air flows is not so great.

At step S103, if it is not decided that the number of print duties that have exceeded the predetermined threshold is two or more, the processing proceeds to step S104 where it checks if the print duty of yellow (Y) ink exceeds the predetermined threshold. If it is decided that the print duty of yellow (Y) ink exceeds the predetermined threshold, the processing proceeds to step S106 where it divides and allocates only the multivalued data of yellow ink according to the allocation table of FIG. 23. As a result, the influences that air flows have on mist of yellow ink because of short distance between the nozzle lines can be alleviated.

If the result of step S104 is "no", the processing proceeds to step S107, where it fixes the multivalued data allocation ratios for all inks at 1:1. With the data value allocation ratios set by step S105, S106, S107, the multivalued data is divided and allocated by step S108 according to the set allocation ratio. After this, the allocated multivalued data is transformed into binary data, according to which ink is ejected from respective nozzle lines to perform printing. Then, step S109 checks if there is a band to be printed next. If the check result is "yes", the processing returns to step S101. If "no", the processing stops.

If the step S102 finds that no print duties exceed the predetermined threshold, the processing proceeds to step S107 where it fixes the data allocation ratios for all inks to 1:1.

In the nozzle lines C1, M1, Y1, Y2, M2, C2, the allocation of multivalued data as described above results in one of two adjoining nozzle lines being assigned the greater of the data allocation ratios and the other the smaller of the data allocation ratios. That is, the data value allocation ratios for the nozzle lines C1, Y1, M2 are large while the data value allocation ratios for the nozzle lines M1, Y2, C2 are small. It is also possible to provide three or more (M) nozzle lines for each ink color C, M, Y.

Next, a first and a second example of control of the print head will be explained as follows.

First Example of Control

Figure 6B:
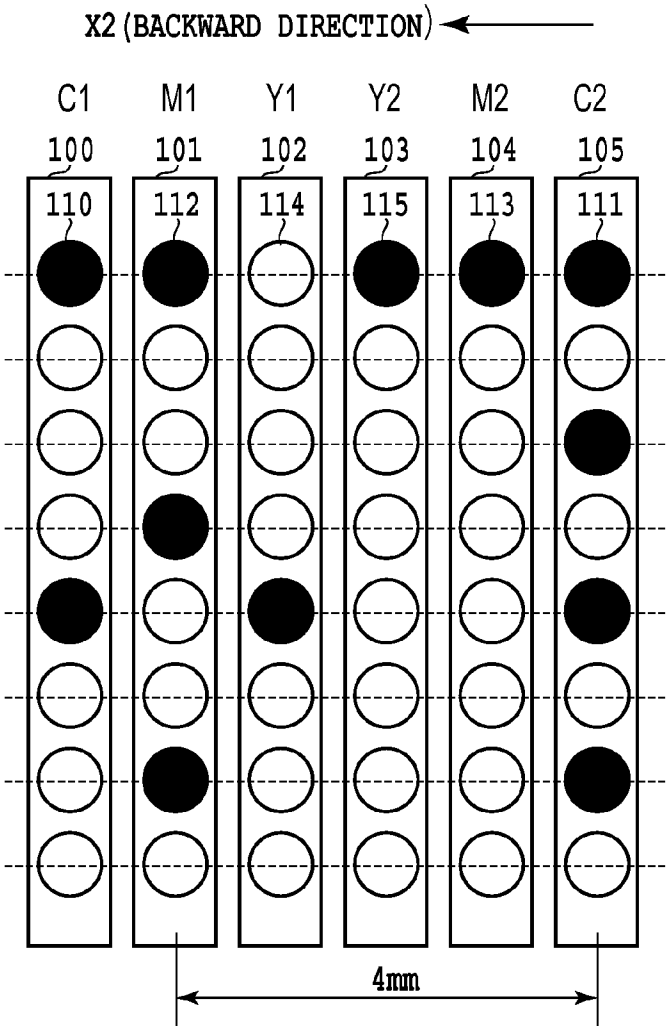
FIGS. 6A and 6B are schematic diagrams showing a first example of control in the first embodiment of this invention.
Figure 6A:
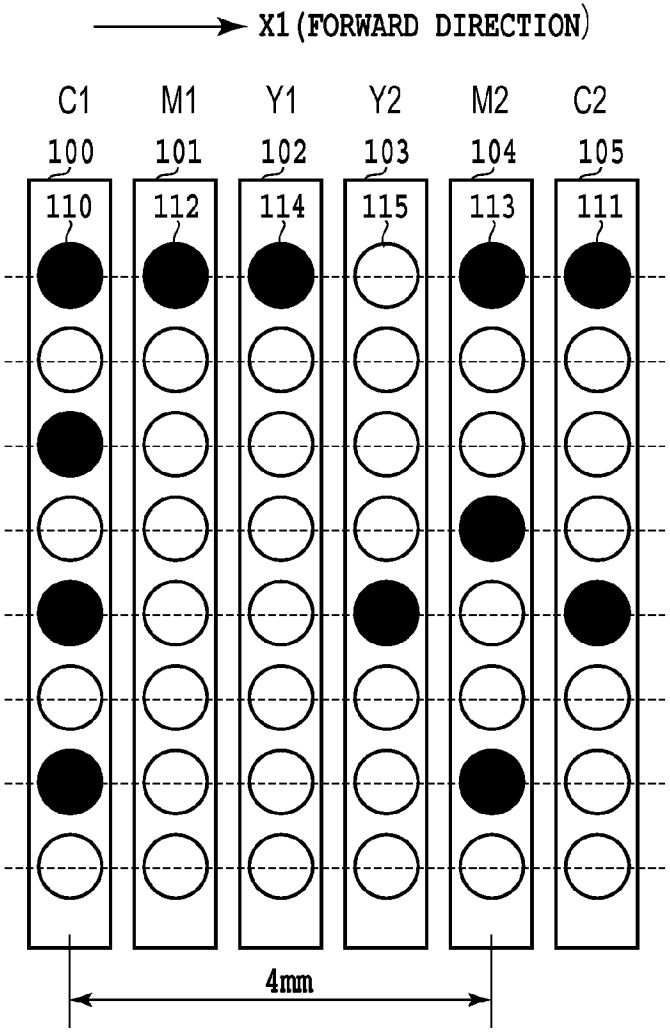

FIG. 6A and FIG. 6B shows how, in a 2-pass bidirectional printing operation, nozzles of the print head are activated to print an image when print duties for cyan, magenta and yellow ink are 75%, 50% and 25%. FIG. 6A shows a state of nozzle activation during a forward scan and FIG. 6B a state of nozzle activation during a backward scan. Solid black circles in the figures represent driven nozzles. In the 2-pass bidirectional printing operation, an image in a predetermined print area is completed by two scans (two passes)—forward scan and backward scan. In this 2-pass printing, the print duties DC, DM, DY are 37.5% (=75/2%), 25% (=50/2%) and 12.5% (=25/2%), respectively.

Nozzle lines C1, M1, Y1, Y2, M2, C2 are arranged so that ink colors are ejected symmetrically, i.e., in the order of cyan, magenta, yellow, yellow, magenta and cyan. With this arrangement, even when secondary colors are printed, the ink ejection order remains unchanged during the forward and backward scans, producing no color variations which would otherwise be caused by a difference in the ink ejection order.

In this example, the print duties of cyan and magenta inks are higher than the predetermined threshold and the print duty of yellow ink is lower than the predetermined threshold. Therefore, during the forward scan, as shown in FIG. 6A, the multivalued data for cyan ink is divided and allocated to the nozzle lines C1, C2 at a ratio of 2:1 for the pixels whose data value is large. As a result, the print duty for the nozzle line C1 is approximately 25% and that of the nozzle line C2 is about 12.5%. Similarly, the multivalued data for magenta ink is divided and allocated to the nozzle lines M1, M2 at a ratio of 1:3 for the pixels whose data value is large. The multivalued data for yellow ink is allocated to the nozzle lines Y1, Y2 at a fixed ratio of 1:1 to distribute the data evenly among all pixels.

Figure 19:
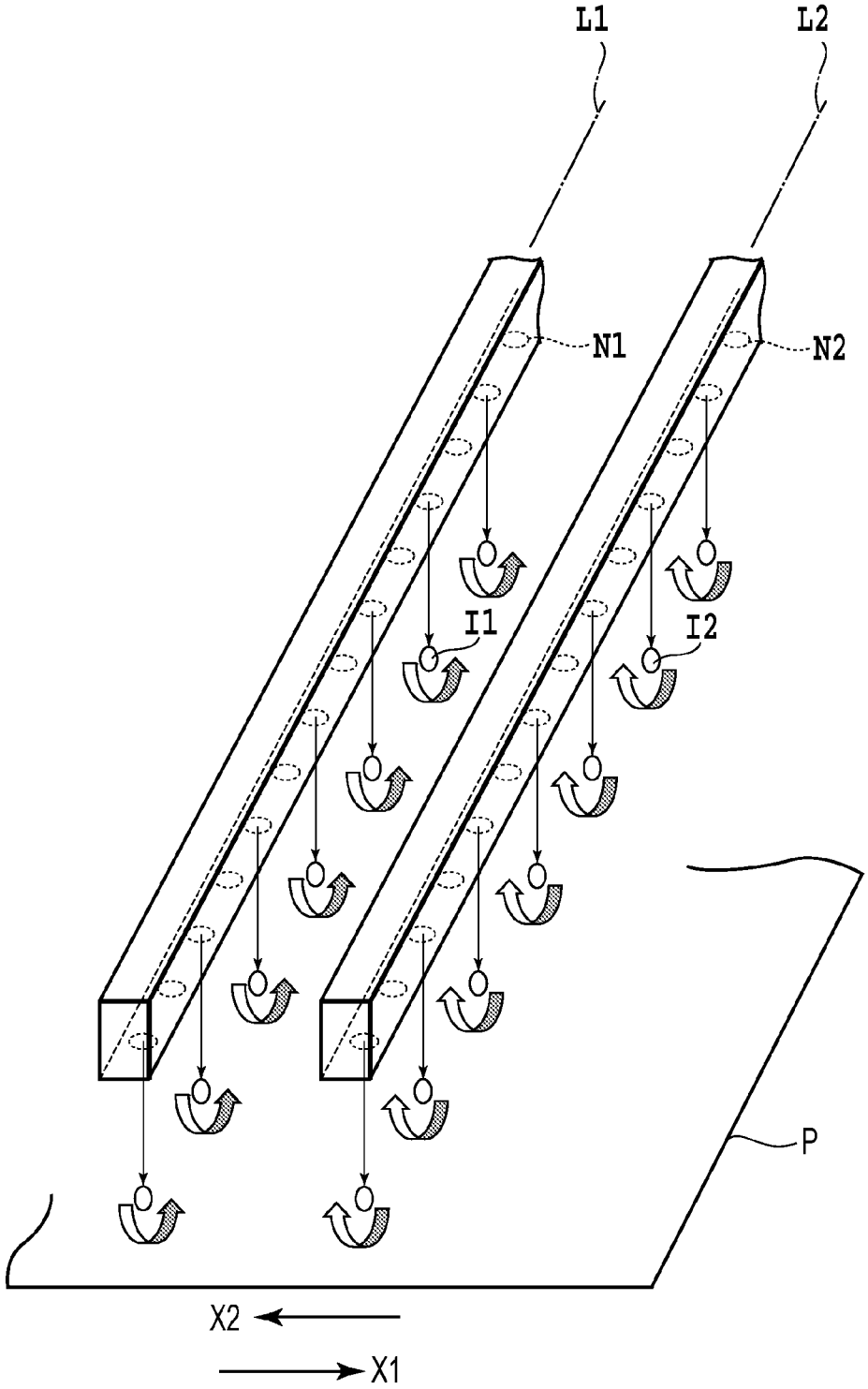
FIG. 19 is a schematic view showing air flows generated by ink droplets ejected from the ink jet print head.

As can be seen from FIG. 6A, the number of nozzles in each column that are driven in the unit print area is particularly large with the nozzle lines C1, M2. Therefore, near the ejection opening in the nozzle lines C1, M2 there is an increased tendency for depressurization. FIG. 19 explained earlier shows how air flows are generated when the print duties of the nozzle lines L1, L2 are the same as that of the nozzle line M2. In this example, too, near the ejection openings in the nozzle lines C1, M2 whose print duties are high because of high data allocation ratio, wrapping air flows are formed that rise from the print medium side, as shown in FIG. 19.

However, since the distance between the nozzle lines C1 and M2 with high print duties is as large as 4 mm, air flow escape paths are formed between the nozzles. As a result, satellites 12 ejected from the nozzle lines C1, M2 (see FIG. 3A to FIG. 3D) and mist formed by a part of the main droplet 11 bouncing from the print medium 8 are less likely to adhere to the ejection face of the print head.

During a backward scan, the allocation ratios of the multivalued data between the nozzle lines C1 and C2, between the nozzle lines M1 and M2 and between the nozzle lines Y1 and Y2 are reversed. That is, as shown in FIG. 6B, for the pixels whose data value is large, the multivalued data for cyan ink is divided and allocated to the nozzle lines C1, C2 at a ratio of 1:2 and the multivalued data for magenta ink is allocated to the nozzle lines M1, M2 at a ratio of 3:1. The multivalued data for yellow ink is divided between the nozzle lines Y1, Y2 at a fixed ratio of 1:1 to distribute the data uniformly among all pixels.

As can be seen from FIG. 6B, the number of nozzles in each column that are driven in the unit print area is particularly large with the nozzle lines C2, M1.

Therefore, during the backward scan, near the ejection openings in the nozzle lines C2, M1, there is an increased depressurization. However, since the distance between the nozzle lines C2 and M1 with high print duties is as large as 4 mm, air flow escape paths are formed between these nozzle lines. As a result, satellites 12 ejected from the nozzle lines C2, M1 (see FIG. 3A to FIG. 3D) and mist formed by a part of the main droplet 11 bouncing from the print medium 8 are less likely to adhere to the ejection face of the print head.

Figure 20A:
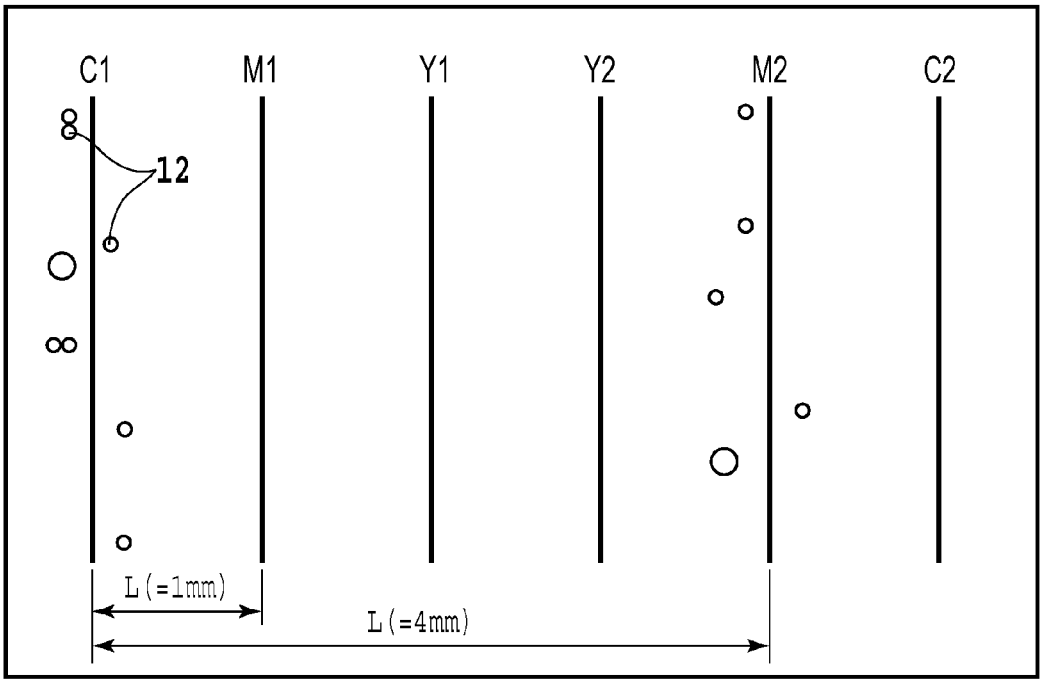
FIGS. 20A and 20B are schematic diagram showing a state of ink mist adhering to the print head when ink is ejected from two nozzle lines set 4 mm apart.
Figure 20B:
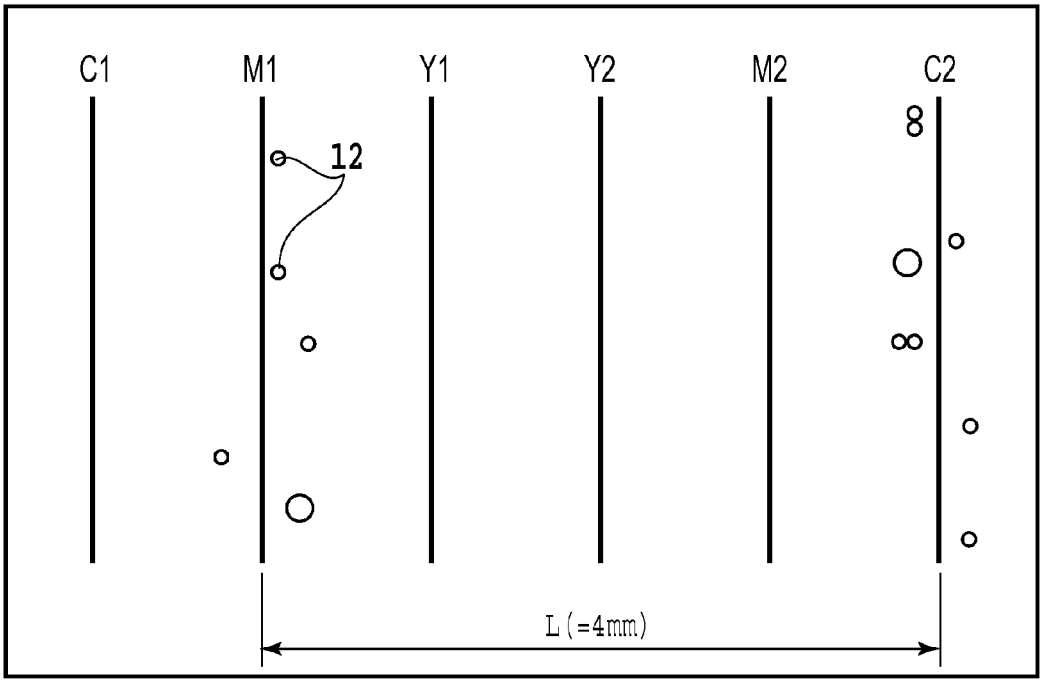

By allocating the multivalued data as the ink ejection data as described above, the distance between the nozzle lines with high print duties can be set large to minimize the amount of mist adhering to the ejection face of the print head, as with the cases of FIGS. 20A and 20B. This in turn can reduce the possibility of ink ejection failure that would otherwise be caused by mist and its aggregates clogging the ejection openings.

Although reversing the multivalued data allocation ratio for the nozzle lines of each color between the forward scan and the backward scan is not essential, the reversing can help reduce deviations in a frequency of use of the nozzle lines.

While in the above example the multivalued data has been described to be divided and allocated among a plurality of nozzle line of the same color, it is possible to allocate binary data obtained by the binarization process. In that case, the binary data for each ink color needs only to be divided and allocated among the nozzle lines at an allocation ratio that is determined for each group of pixels according to the data value (equivalent to the number of dots) and the direction of scan.

As for the multivalued data whose print duty exceeds the predetermined threshold, the multivalued data allocation ratio is set to other than 1:1 for those pixels whose data value is large (pixels with data value of 65 or higher) and, for those pixels whose data value is 64 or lower, the multivalued data allocation ratio is set to 1:1. As described above, by focusing on the pixels that are particularly vulnerable to the influences of air flows and using different nozzle line data allocation ratios for pixels with high data value and for pixels with low data value, deviations in the frequency of use among different nozzles can be minimized to reduce the chance of mist adhering to the ejection face of the print head. However, the multivalued data whose print duty exceeds the predetermined threshold may also be divided and allocated at different ratios for all pixels regardless of their data values.

Second Example of Control

Figure 7B:
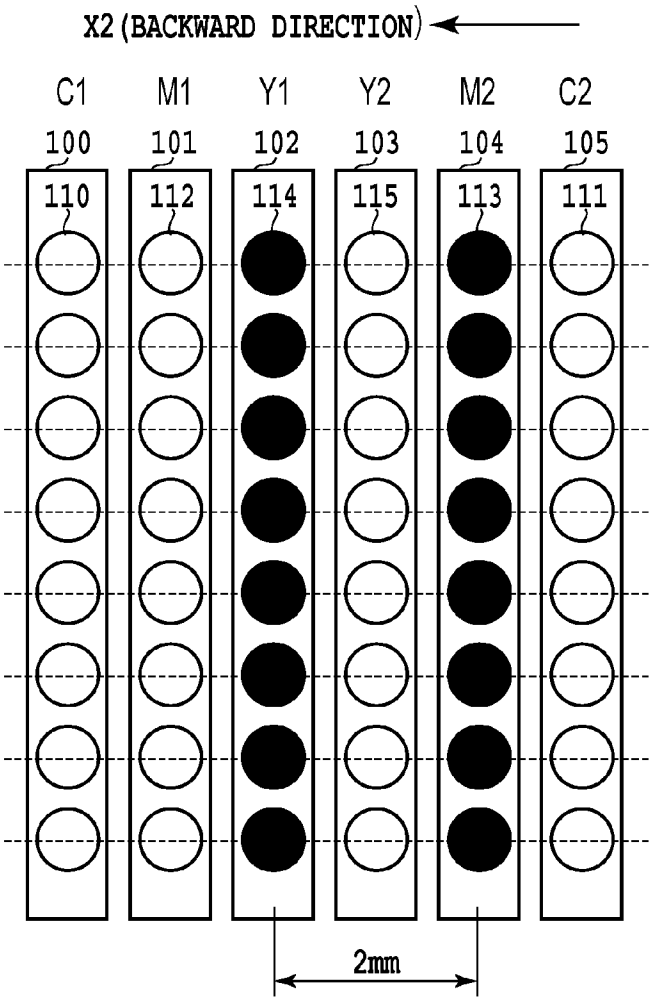
FIGS. 7A and 7B are schematic diagrams showing a second example of control in the first embodiment of this invention.
Figure 7A:
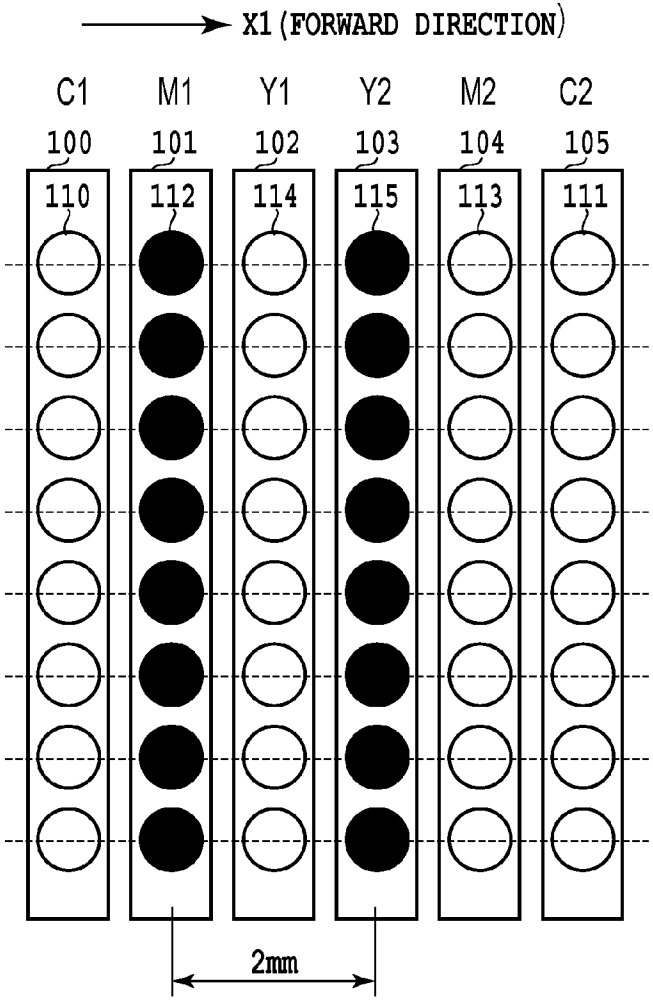

FIG. 7A and FIG. 7B show a nozzle activation state when an image is formed by a 2-pass bidirectional printing with 100% print duties for magenta and yellow inks. The print duties DM, DY are 50% (=100/2%).

In this example, during the forward scan, multivalued data for magenta ink is allocated to the magenta nozzle line M1 according to an allocation table (not shown) designed to make only the nozzle line M1 of nozzle lines M1, M2 perform printing, as shown in FIG. 7A. Similarly, the multivalued data for yellow ink is allocated according to an allocation table (not shown) designed to have only the nozzle line Y2 of nozzle lines Y1, Y2 to perform printing. The number of nozzles driven in each column within the unit print area or one-scan print area is 256 nozzles, all nozzles of each column, when the print duty is 50%. So, during the forward scan, there tends to be an increased depressurization near the ejection openings of the nozzle lines M1, Y2 which have high data allocation ratios and therefore high print duties, generating wrapping air flows that rise from the print medium side, as shown in FIG. 19.

However, since the distance between the nozzle lines M1 and Y2 is as large as 2 mm, air flow escape paths are formed between these nozzle lines. As a result, satellites 12 ejected from the nozzle lines M1, Y2 (see FIG. 3A to FIG. 3D) and mist formed by a part of the main droplet 11 bouncing from the print medium 8 are less likely to adhere to the ejection face of the print head.

During a backward scan, on the other hand, the allocation ratios of the multivalued data between the nozzle lines M1 and M2 and between the nozzle lines Y1 and Y2 are reversed. That is, as shown in FIG. 7B, the multivalued data for magenta ink is allocated according to an allocation table (not shown) designed to have only the nozzle line M2 of nozzle lines M1, M2 perform printing. Similarly, the multivalued data for yellow ink is allocated according to an allocation table (not shown) designed to have only the nozzle line Y1 of nozzle lines Y1, Y2 perform printing.

Therefore, during the backward scan, there tends to be an increased depressurization near the ejection openings in the nozzle lines M2, Y1, generating wrapping air flows that rise from the print medium side, as shown in FIG. 19.

However, since the distance between the nozzle lines M2 and Y1 is as large as 2 mm, air flow escape paths are formed between these nozzle lines. As a result, satellites 12 ejected from the nozzle lines M2, Y1 (see FIG. 3A to FIG. 3D) and mist formed by a part of the main droplet 11 bouncing from the print medium 8 are less likely to adhere to the ejection face of the print head.

Figure 21A:
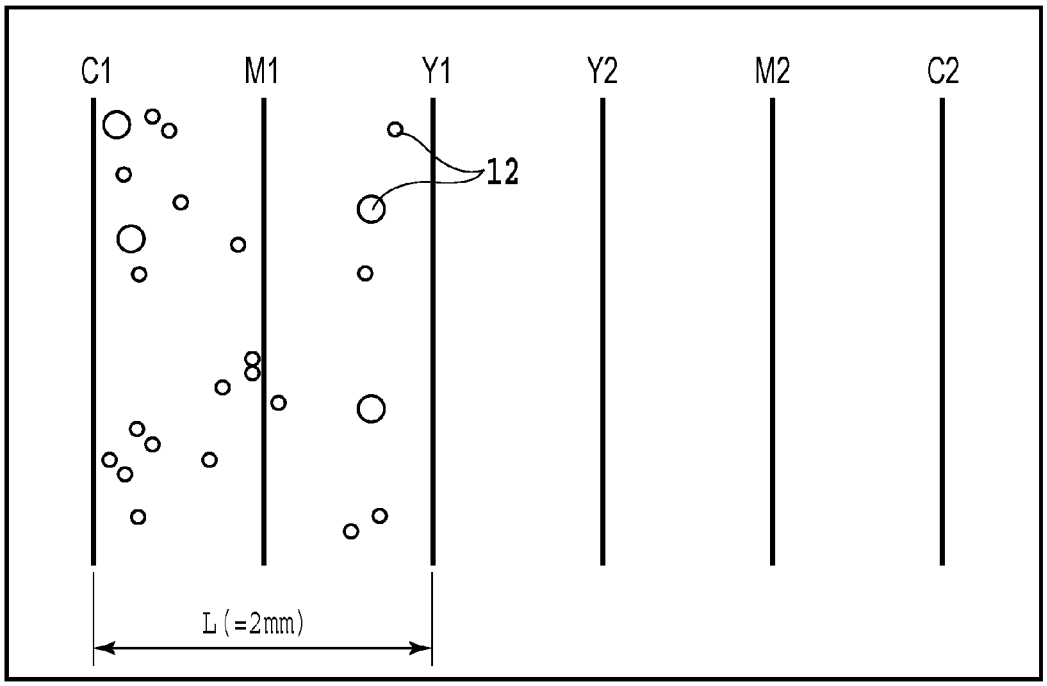
FIGS. 21A and 21B are schematic diagram showing a state of ink mist adhering to the print head when ink is ejected from two nozzle lines set 2 mm apart.
Figure 21B:
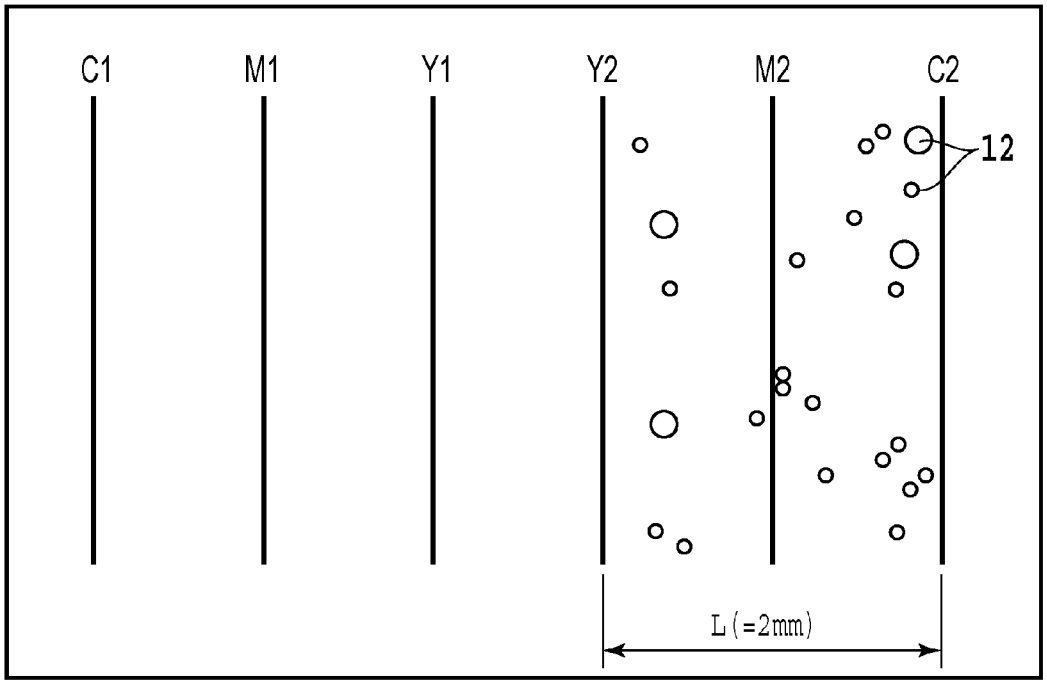
Figure 22A:
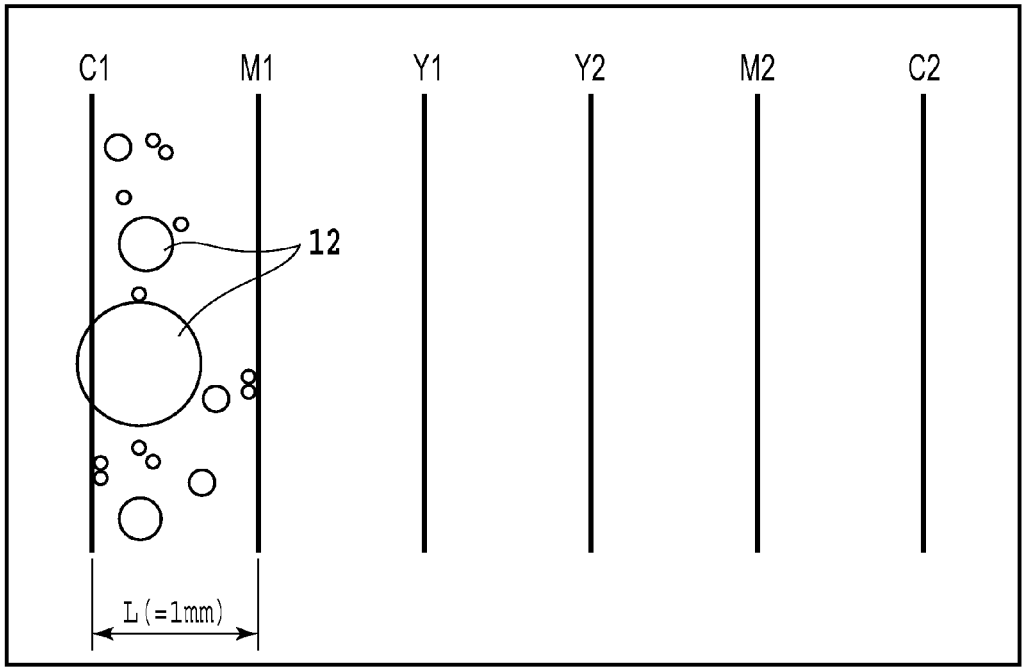
FIGS. 22A and 22B are schematic diagram showing a state of ink mist adhering to the print head when ink is ejected from two nozzle lines set 1 mm apart.
Figure 22B:
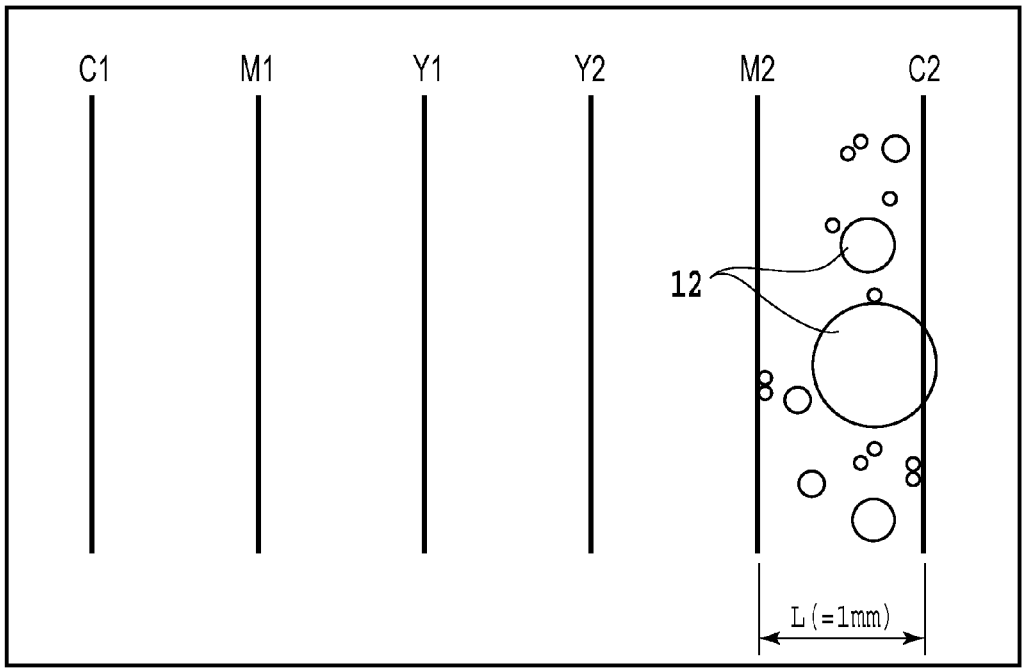

By allocating the multivalued data as described above, the distance between the nozzle lines with high print duties can be so large to minimize the amount of mist adhering to the ejection face of the print head, as in the case of FIG. 21A and FIG. 21B. This in turn can prevent ink ejection failures that would otherwise be caused by mist and its aggregates clogging the ejection openings. In addition, the magenta and yellow inks are ejected in the order of yellow ink followed by magenta ink during both the forward scan of FIG. 7A and backward scan of FIG. 7B, producing no color variations which would otherwise be caused by a difference in the ink ejection order.

First Comparison Example

Figure 8B:
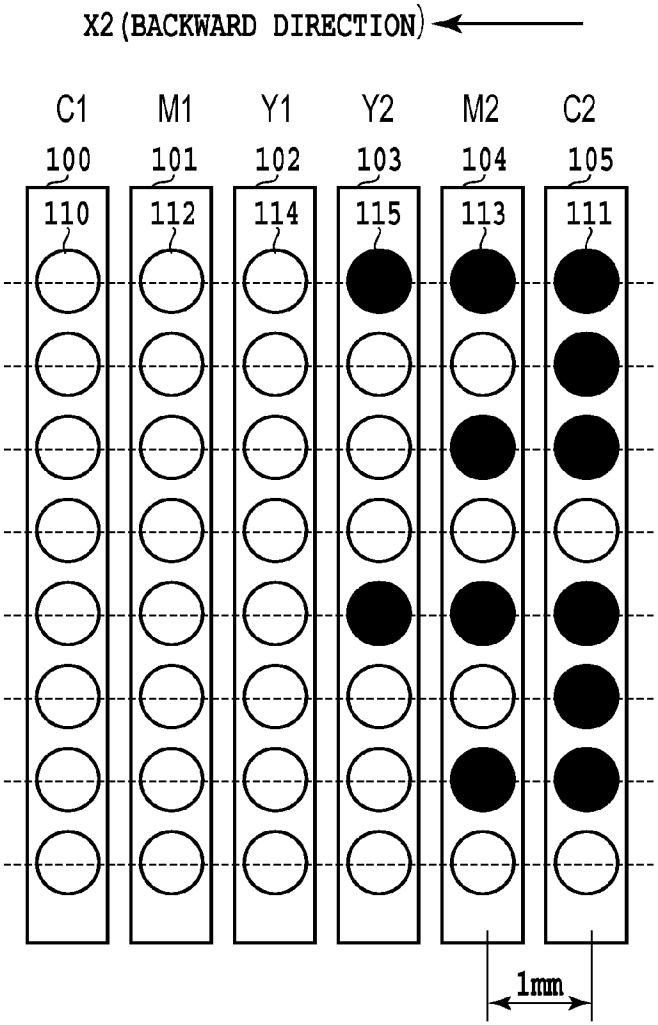
FIGS. 8A and 8B are schematic diagrams showing a result of allocation of print data in a first comparison example.
Figure 8A:
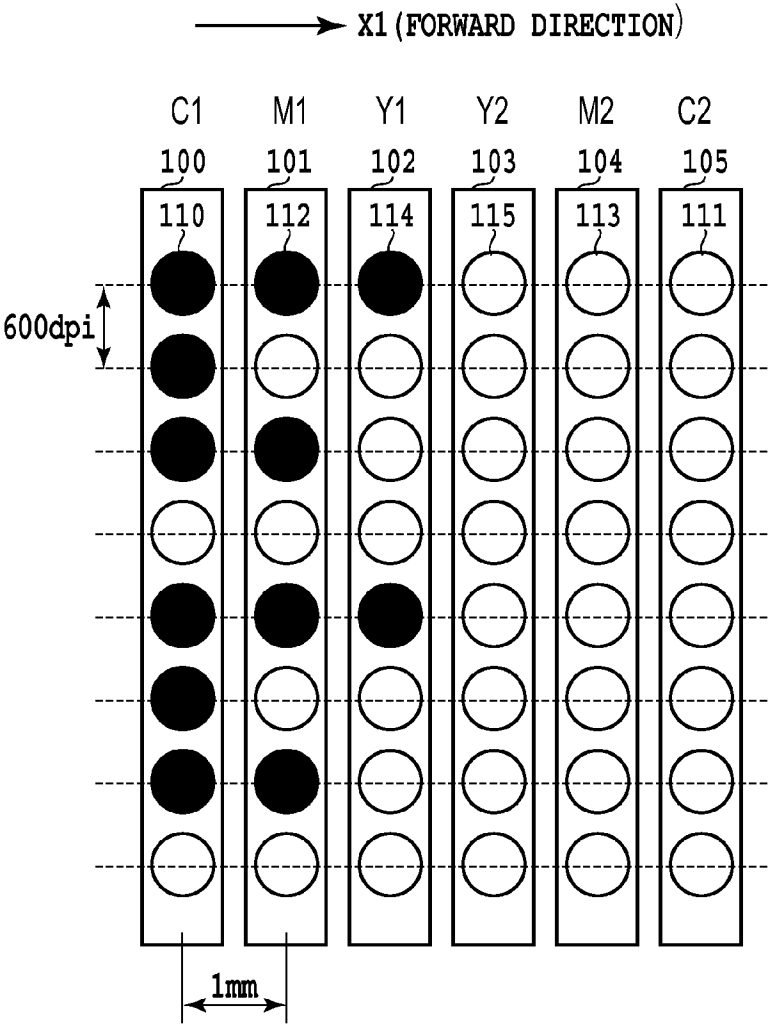

FIG. 8A and FIG. 8B show a first comparison example. This comparison example represents a case of a 2-pass bidirectional printing which uses an allocation table (not shown) that allocates the multivalued data to only the nozzle lines C1, M1, Y1 during the forward scan as shown in FIG. 8A. During the backward scan, an allocation table (not shown) is used that allocates the multivalued data to only the nozzle lines C2, M2, Y2 as shown in FIG. 8B.

During the forward scan as shown in FIG. 8A, the print duties of the nozzle lines C1, M1 are high, increasing the depressurization tendency near the ejection openings of these nozzle lines, which in turn forms wrapping air flows rising from the print medium side, as shown in FIG. 19. The distance between these nozzle lines C1 and M1 is as short as 1 mm, so air flow escape paths are unlikely to be formed between them. As a result, satellites 12 ejected from the nozzle lines C1, M1 (see FIG. 3A to FIG. 3D) and mist formed by a part of the main droplet 11 bouncing from the print medium 8 may adhere in large quantities to the ejection face of the print head.

During the backward scan of FIG. 8B on the other hand, the print duties of the nozzle lines C2, M2 are high, increasing the depressurization tendency near the ejection openings of these nozzle lines, which in turn forms wrapping air flows rising from the print medium side, as shown in FIG. 19. Since the distance between the nozzles C2 and M2 is as short as 1 mm, air flow escape paths are unlikely to be formed between them. As a result, satellites 12 ejected from the nozzle lines C2, M2 (see FIG. 3A to FIG. 3D) and mist formed by a part of the main droplet 11 bouncing from the print medium 8 may adhere in large quantities to the ejection face of the print head.

The large quantity of mist and its aggregates, once they adhere to the ejection face of the print head, are likely to clog the ejection openings causing ink ejection failures.

Second Comparison Example

Figure 9B:
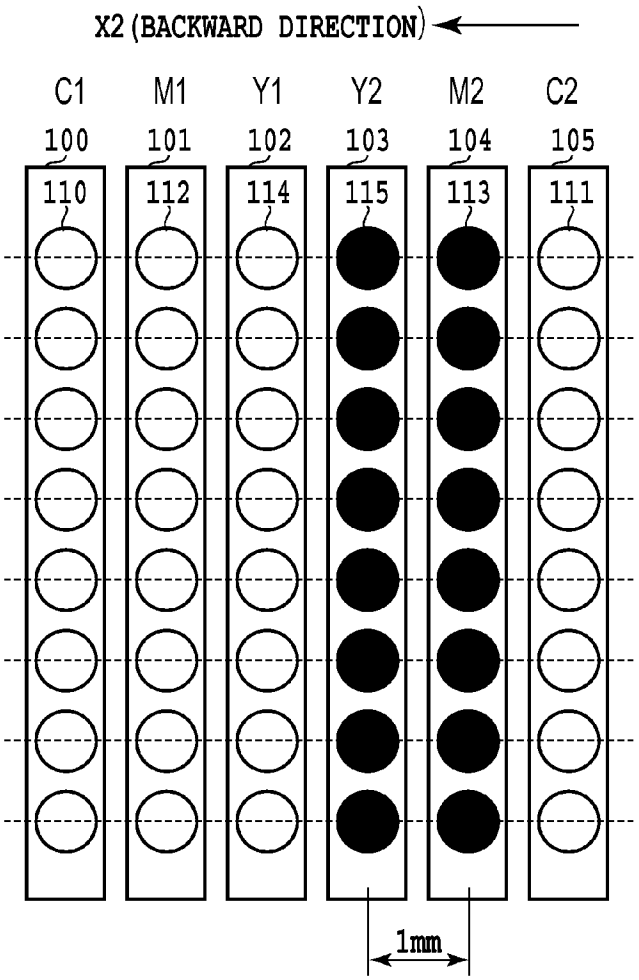
FIGS. 9A and 9B are schematic diagrams showing a result of allocation of print data in a second comparison example.
Figure 9A:
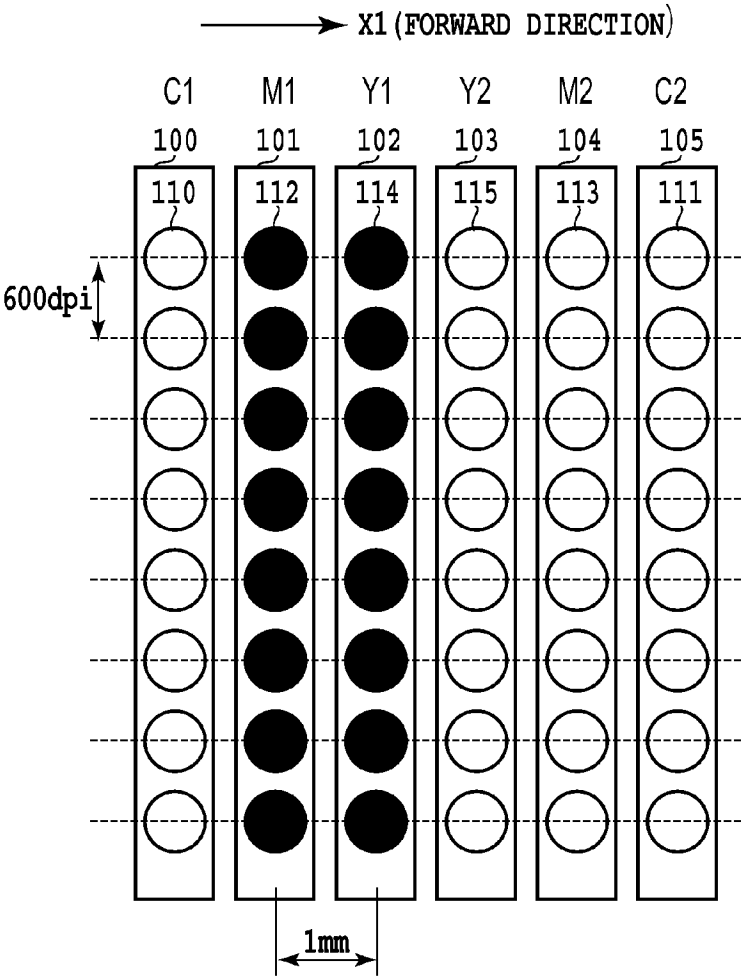

FIG. 9A and FIG. 9B show a second comparison example. This comparison example represents a case of a 2-pass bidirectional printing which uses an allocation table (not shown) that allocates data to only the nozzle lines M1, Y1 during the forward scan as shown in FIG. 9A. During the backward scan, an allocation table (not shown) is used that allocates data to only the nozzle line M2, Y2 as shown in FIG. 9B.

During the forward scan as shown in FIG. 9A, the print duties of the nozzle lines M1, Y1 are high, increasing the depressurization near the ejection openings of these nozzle lines. During the backward scan as shown in FIG. 9B, the print duties of the nozzle lines M2, Y2 are high, increasing the depressurization near the ejection openings of these nozzle lines. Since the distance between the nozzle lines M1 and Y1 and the distance between the nozzle lines M2 and Y2 are both as short as 1 mm, air flow escape paths are unlikely to be formed between them. As a result, satellites 12 ejected from these nozzle lines (see FIG. 3A to FIG. 3D) and mist formed by a part of the main droplet 11 bouncing from the print medium 8 may adhere in large quantities to the ejection face of the print head. The large quantity of mist and its aggregates, once they adhere to the ejection face of the print head, are likely to clog the ejection openings causing ink ejection failures.

Second Embodiment

Figure 10B:
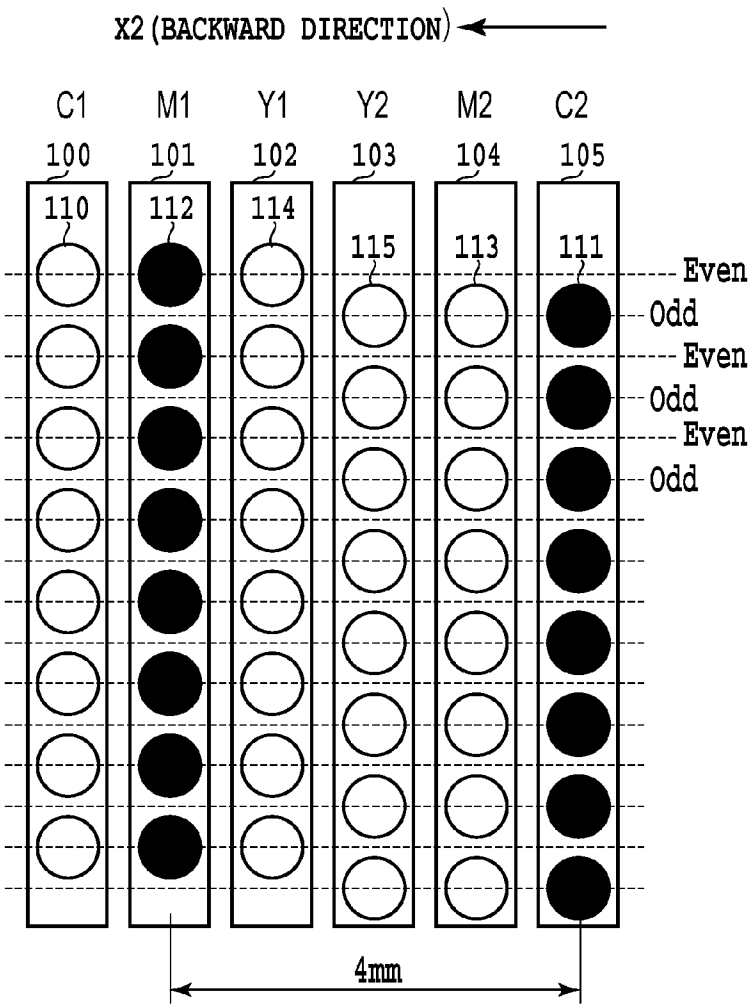
FIGS. 10A and 10B are schematic diagrams showing an example of control in a second embodiment of this invention.
Figure 10A:
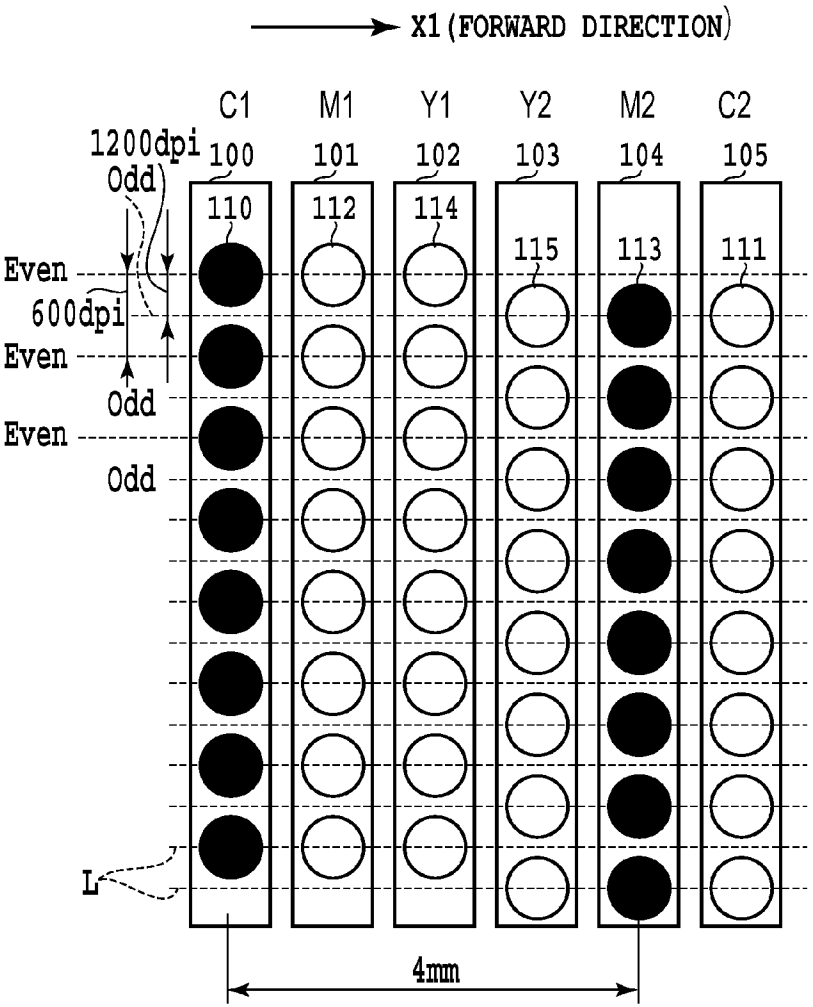

Nozzles in a print head of this embodiment, as shown in FIG. 10A and FIG. 10B, are arrayed at a pitch of 600 dpi. Nozzles of nozzle lines C1, M1, Y1 are shifted one-half pitch from those of nozzle lines C2, M2, Y2 in the subscan direction. As a result, the nozzle lines C1, C2 together provide a print density in the subscan direction of 1200 dpi. Similarly, the nozzle lines M1, M2 together provide a print density in the subscan direction of 1200 dpi. The nozzle lines Y1, Y2 also combine to produce a subscan direction print density of 1200 dpi. The distances between these nozzle lines are 1 mm. In each nozzle line there are 256 nozzles, ejecting ink droplets of 5 pl each. In FIGS. 10A and 10B, only eight nozzles are representatively shown in each nozzle line. A maximum possible drive frequency (ink droplet ejection frequency) is 30 kHz. Horizontal broken lines L in FIG. 10A represent main scan lines, along which image pixels are formed, i.e., rasters of the image. In this example, a dot can be formed in a 1200×1200-dpi unit area according to print data. Further, the printing apparatus in this embodiment, unlike the first embodiment, has a two-step quantization process.

Figure 24:
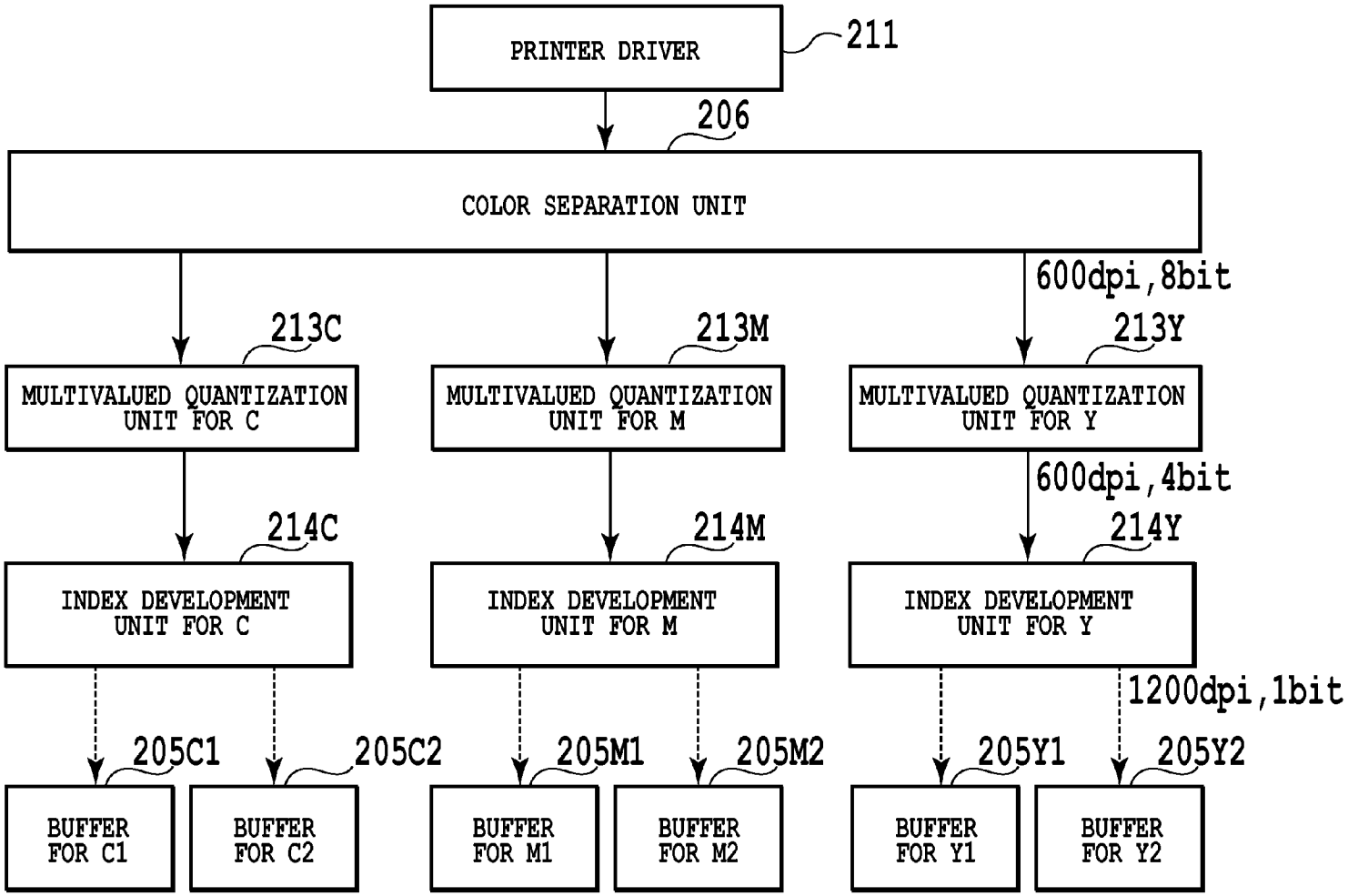
FIG. 24 is a block diagram showing a CPU processing function in the second embodiment of this invention.

FIG. 24 is a schematic diagram showing a procedure of image processing executed by the CPU 201 in the controller 200. The CPU 201 in the controller 200 that has received the multivalued brightness data RGB performs a color separation process on the brightness data RGB at 600 ppi by using the color separation unit 206 to produce 600-ppi multivalued gradation data CMY for the associated ink color used in the printing apparatus. Then, a multivalued quantization process is performed on the multivalued gradation data CMY by quantization units 213C, 213M, 213Y for the associated ink colors to convert the 256-level gradation data into 600-ppi 3-level (0-2) gradation data. Then, index development units 214C, 214M, 214Y for three ink colors are activated to perform an index development process to convert the 600-ppi 3-level gradation data into 1200-dpi binary data. After this, these binary data is stored in the buffers 205C1, 205C2, 205M1, 205M2, 205Y1, 205Y2.

This embodiment is characterized by an index pattern that is referenced when the above index development process is executed.

FIG. 25A, FIG. 25B and FIG. 25C show index patterns.

An index C of FIG. 25C represents an index pattern used when a print duty is low. The values of 0-2 shown to the left of the figure are input values to the index development unit, i.e., levels of output values of the multivalued quantization process. The pattern to the right of the figure represents four (2×2) 1200-dpi pixels corresponding to one 600-ppi pixel region. A circle in individual 1200-dpi pixels indicates that the pixels marked with the circle are print pixels that to be formed with a dot by ink ejection. Pixels not marked with a circle are no-print pixels to which no ink droplet is to be ejected. The number of print pixels marked with the circle increases with the level.

In the index C, when the level is 0, there is only one method of arranging dots in 2×2 pixels (0A). When the level is 1, there are two methods of arranging dots (1A, 1B). When the level is 2, there is only one method of arranging dots in 2×2 pixels (2B). In this embodiment, when the level is 1, the two dot arrangement patterns (1A, 1B) are sequentially or randomly used.

The index A of FIG. 25A and the index B of FIG. 25B represent index patterns used when the print duty is high. In these indexes A and B, the dot arrangement pattern for level 0 is the same as that of index C whereas, for level 1 and level 2, the indexes A and B, unlike index C, provide only one dot arrangement pattern each. In the 2×2 pixel pattern with an upper tier taken as an even row and a lower tier as an odd row, the index A is designed to have print pixels concentrate in the odd row. The index B on the other hand is designed to have print pixels concentrate in the even row. These indexes A, B and C are stored in ROM 203 of the printing apparatus and the CPU 201 selects an appropriate pattern from the ROM 203 according to various conditions and level values.

As can be seen from FIG. 10A and FIG. 10B, the nozzle line C1 prints the even row and the nozzle line C2 prints the odd row. Therefore, when the number of ink ejections from the nozzle line C1 is increased, it is better to select the index B, and when the number of ink ejections from the nozzle line C2 is increased, it is better to select the index A. This step allows the number of ejections in each nozzle line to be practically adjusted.

In each printing scan, the index A and index B are selectively used according to the direction of scan. More specifically, when the printing is done during the forward scan, the index development process is performed according to the index B to suppress the print duty of the nozzle line C2 moving at the front. When the printing is done during the backward scan, the index development process is performed according to the index A to suppress the print duty of the nozzle line C1 moving at the front.

Referring again to FIG. 24, the binary data for each ink color that has been binarized by the index development process is separated for individual nozzle lines and stored in the corresponding buffers 205C1-205Y2 in the RAM 205. The stored binary data is transferred by the CPU 201 to the head driver (see FIG. 2A) for each printing scan. Based on the binary data, the ejection heaters as ejection energy generation means are energized to execute the ink ejection operation during each printing scan.

As described above, this embodiment provides a plurality of index patterns, one of which is chosen according to the direction of scan (forward or backward scan). The above process makes this embodiment simpler in construction than the first embodiment that detects the value of multivalued gradation data and divides and allocates the data value to the two nozzle lines.

FIG. 10A and FIG. 10B show a nozzle activation state when the print duty of cyan and magenta inks is 100%, i.e., when a secondary color is formed of these inks at a maximum gradation level. Images are formed by a 2-pass bidirectional printing, as in the preceding embodiment. Print duties DC, DM of these nozzle lines are both 50% (100/2%).

In this example, during the forward scan, the index patterns used for processing cyan and magenta ink ejection data are 2A in index B of FIGS. 25B and 2C in index A of FIG. 25A, respectively. Thus, as shown in FIG. 10A, the print duties of the nozzle lines C1, M2 are high and the print duties of the nozzle lines M1, C2 are low. Therefore, during the forward scan there tends to be an increased depressurization near the ejection openings of the nozzle lines C1, M2 with high print duties, which in turn forms wrapping air flows rising from the print medium side, as shown in FIG. 19.

However, since the distance between the nozzle lines C1 and M2 is as large as 4 mm, air flow escape paths are formed between these nozzle lines. As a result, satellites 12 ejected from the nozzle lines C1, M2 (see FIG. 3A to FIG. 3D) and mist formed by a part of the main droplet 11 bouncing from the print medium 8 are less likely to adhere to the ejection face of the print head.

During a backward scan, on the other hand, the index patterns used for processing the cyan and magenta ink ejection data are 2C in index A of FIGS. 25A and 2A in index B of FIG. 25B, respectively. The print pixel allocation ratios between the nozzle lines C1 and C2 and between the nozzle lines M1 and M2 are reversed. That is, as shown in FIG. 10B, the print duties of the nozzle lines C2, M1 are high and print duties of the nozzle lines C1, M2 are low. Therefore, during the backward scan, near the ejection openings of the nozzle lines C2, M1 with high print duties, there tends to be an increased depressurization which in turn forms wrapping air flows rising from the print medium, as shown in FIG. 19.

However, since the distance between the nozzle lines C2 and M1 is as large as 4 mm, air flow escape paths are formed between these nozzle lines. As a result, satellites 12 ejected from the nozzle lines C2, M1 (see FIG. 3A to FIG. 3D) and mist formed by a part of the main droplet 11 bouncing from the print medium 8 are less likely to adhere to the ejection face of the print head.

By selecting an index pattern for each nozzle line as described above, the distance between the nozzle lines with high print duties can be so large to minimize the amount of mist adhering to the ejection face of the print head, as in the case of FIG. 20A and FIG. 20B. This in turn prevents ink ejection failures that would otherwise be caused by mist and its aggregates clogging the ejection openings.

Furthermore, the cyan and magenta inks are ejected in the order of magenta ink followed by cyan ink during both the forward scan of FIG. 10A and backward scan of FIG. 10B, producing no color variations which would otherwise be caused by a difference in the ink ejection order.

Contrary to what is described above, a secondary color based on cyan and magenta inks may be formed by using the nozzle lines M1, C2 of FIG. 10B during the forward scan and the nozzle lines C1, M2 of FIG. 10A during the backward scan.

It is also possible to form a secondary color based on magenta and yellow inks by using nozzle lines Y1, M2 during the forward scan and nozzle lines Y2, M1 during the backward scan, thereby minimizing the amount of mist adhering to the ejection face of the print head, preventing ink ejection failures. Conversely, nozzle lines Y2, M1 may also be used during the forward scan and nozzle lines Y1, M2 during the backward scan.

Third Comparison Example

This comparison example represents a case where the same print head as used in the second embodiment is used and in which the print duty of cyan and magenta inks is 100%, i.e., a secondary color is formed of these inks at a maximum gradation level. Images are formed by a 2-pass bidirectional printing, as in the preceding embodiment. Print duties DC, DM are both 50% (100/2%).

In this example, the index patterns used for processing cyan and magenta ink ejection data are 2B and 0A in index C of FIG. 25C in both the forward and backward scans and the nozzle lines C1, C2, M1, M2 are used evenly. So, the print duties of the nozzle lines C1, C2, M1, M2 are somewhat high in both the forward and backward scans.

Figure 11B:
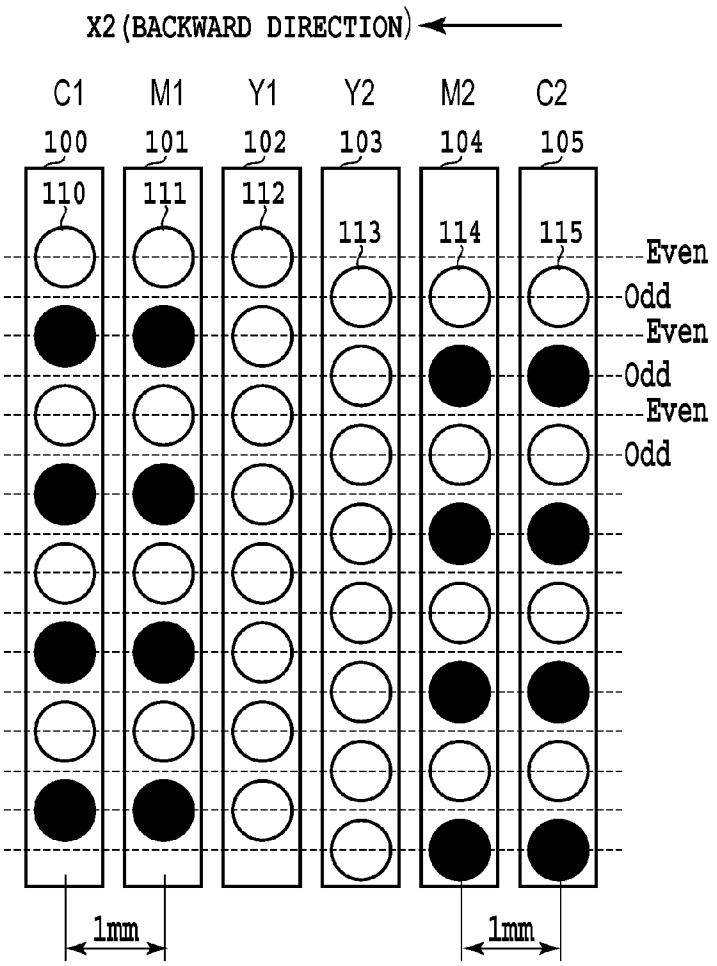
FIGS. 11A and 11B are schematic diagrams showing a result of allocation of print data in a third comparison example.
Figure 11A:
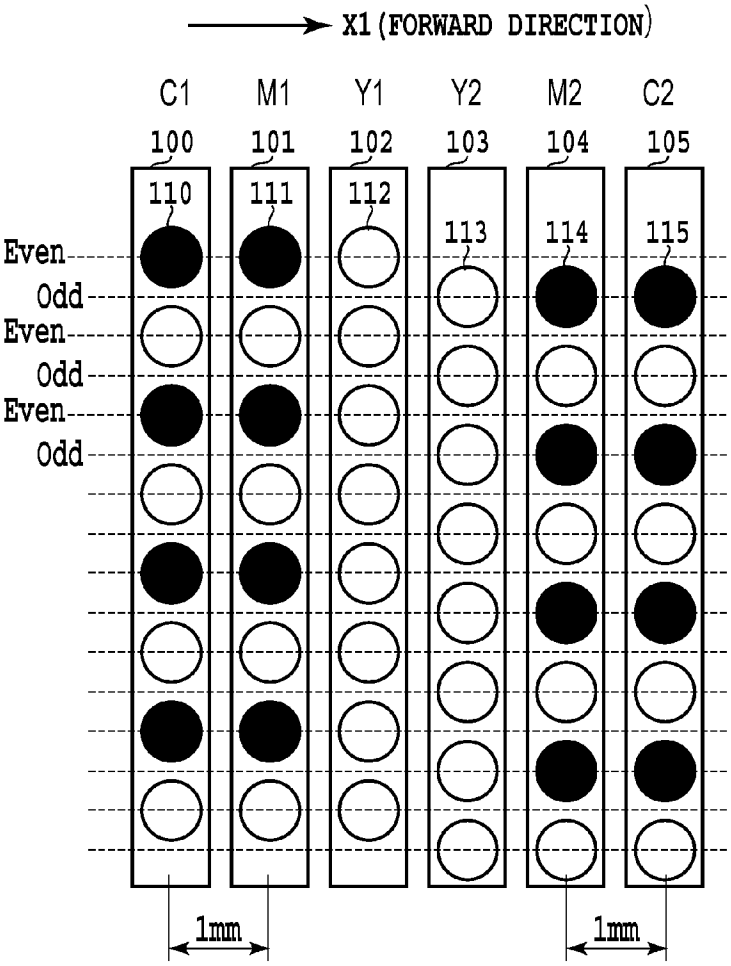

During the forward scan, the print duties of the nozzle lines C1, C2, M1, M2 are somewhat high, as shown in FIG. 11A. Thus, there tends to be an increased depressurization near the ejection openings of these nozzle lines, forming wrapping air flows that rise from the print medium side, as shown in FIG. 19. Since the distance between the nozzle lines C1 and M1 and the distance between the nozzle lines C2 and M2 are as short as 1 mm, air flow escape paths are unlikely to be formed between the paired nozzle lines. As a result, satellites 12 ejected from these nozzle lines (see FIG. 3A to FIG. 3D) and mist formed by a part of the main droplet 11 bouncing from the print medium 8 may adhere in large quantities to the ejection face of the print head.

Similarly, during the backward scan as shown in FIG. 11B, the print duties of all nozzle lines C1, C2, M1, M2 are somewhat high. Therefore, satellites 12 ejected from these nozzle lines (see FIG. 3A to FIG. 3D) and mist formed by a part of the main droplet 11 bouncing from the print medium 8 may easily adhere in large quantities to the ejection face of the print head.

The large quantity of mist and its aggregates, once they adhere to the ejection face of the print head, are likely to clog the ejection openings causing ink ejection failures.

When forming a secondary color using magenta and yellow inks, if the print duties of the nozzle lines M1, M2, Y1, Y2 are set at 25% in both the forward and backward scans, as in this example, large quantities of mist may adhere to the ejection face of the print head, which in turn may cause ink ejection failures.

Third Embodiment

In a print head of this embodiment (see FIG. 12A), a nozzle line C1 has alternated large nozzles 110A for ejecting relatively large cyan ink droplets and small nozzles 110B for ejecting relatively small cyan ink droplets. Similarly, a nozzle line M1 has large nozzles 111A and small nozzles 111B alternated. A nozzle line Y1 has large nozzles 112A and small nozzles 112B alternately arranged. Also a nozzle line Y2 has large nozzles 113A and small nozzles 113B alternated. Similarly, a nozzle line M2 has large nozzles 114A and small nozzles 114B alternated. A nozzle line C2 also has large nozzles 115A and small nozzles 115B alternated. On the same raster L, one of the nozzle lines C1, C2 has a large nozzle and the other a small nozzle. Similarly, on the same raster, one of the nozzle lines M1, M2 has a large nozzle and the other a small nozzle; and one of the nozzle lines Y1, Y2 has a large nozzle and the other a small nozzle.

In this example, each nozzle line has nozzles arrayed at a pitch of 600 dpi. So, in each nozzle line large nozzles are arrayed at a 300-dpi pitch and small nozzles at a 300-dpi pitch. The nozzle lines each have 128 large nozzles and 128 small nozzles, with the large nozzles ejecting large ink droplets of 8 pl and the small nozzles ejecting small ink droplets of 2 pl. FIG. 12A shows only eight nozzles representatively. The print head is driven at a drive frequency (ink droplet ejection frequency) of 15 kHz. Horizontal broken lines L in FIG. 12A represent main scan lines, along which image pixels are formed, i.e., rasters of the image.

Figure 12B:
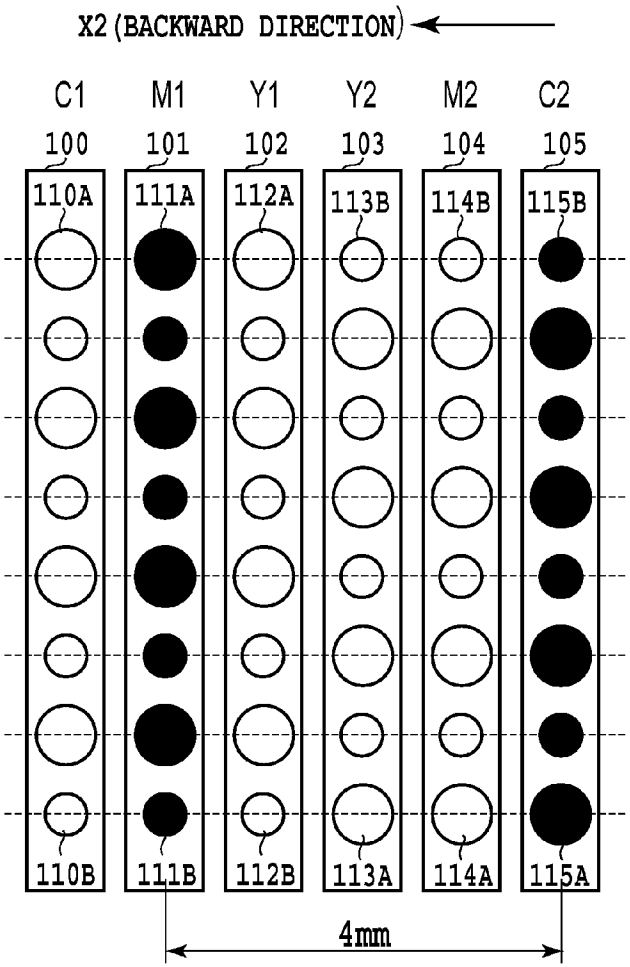
FIGS. 12A and 12B are schematic diagrams showing an example of control in a third embodiment of this invention.
Figure 12A:
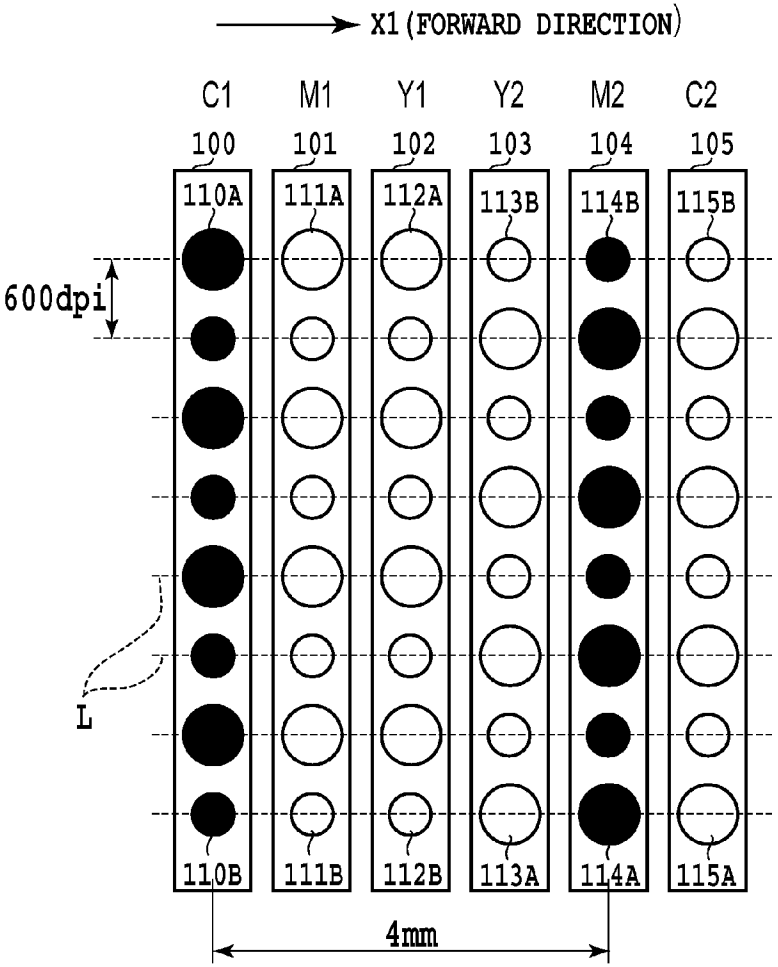

FIG. 12A and FIG. 12B show a nozzle activation state when the print duties of cyan and magenta inks are each 100%, i.e., when a secondary color is formed of these inks at a maximum gradation level. Images are formed by a 2-pass bidirectional printing, as in the preceding embodiment. Print duties DC, DM are both 50% (100/2%).

In this example, during the forward scan, the cyan ink ejection data values are allocated according to an allocation table (not shown) designed to have only the nozzle line C1 of nozzle lines C1, C2 perform printing, as shown in FIG. 12A. In the same way, the magenta ink ejection data values are also allocated according to the allocation table (not shown) designed to have only the nozzle line M2 of nozzle lines M1, M2 perform printing.

Therefore, during the forward scan there tends to be an increased depressurization near the ejection openings of the nozzle lines C1, M2 with high print duties, which in turn forms wrapping air flows rising from the print medium side, as shown in FIG. 19.

However, since the distance between the nozzle lines C1 and M2 is as large as 4 mm, air flow escape paths are formed between these nozzles. As a result, satellites 12 ejected from the nozzle lines C1, M2 (see FIG. 3A to FIG. 3D) and mist formed by a part of the main droplet 11 bouncing from the print medium 8 are less likely to adhere to the ejection face of the print head.

During a backward scan, on the other hand, the allocation ratios of data value between the nozzle lines C1 and C2 and between the nozzle lines M1 and M2 are reversed. That is, as shown in FIG. 12B, the cyan ink ejection data value is allocated according to the allocation table (not shown) designed to have only the nozzle line C2 of nozzle lines C1, C2 perform printing. Similarly, the magenta ink ejection data value also is allocated according to the allocation table (not shown) designed to have only the nozzle line M1 of nozzle lines M1, M2 perform printing. Therefore, during the backward scan, near the ejection openings in the nozzle lines C2, M1 with high print duties, there tends to be an increased depressurization which in turn forms wrapping air flows rising from the print medium, as shown in FIG. 19.

However, since the distance between the nozzle lines C2 and M1 is as large as 4 mm, air flow escape paths are formed between these nozzle lines. As a result, satellites 12 ejected from the nozzle lines C2, M1 (see FIG. 3A to FIG. 3D) and mist formed by a part of the main droplet 11 bouncing from the print medium 8 are less likely to adhere to the ejection face of the print head.

By allocating the data value as described above, the distance between the nozzle lines with high print duties can be so large to minimize the amount of mist adhering to the ejection face of the print head, as in the case of FIG. 20A and FIG. 20B. This in turn can prevent ink ejection failures that would otherwise be caused by mist and its aggregates clogging the ejection openings.

Furthermore, the cyan and magenta inks are ejected in the order of magenta ink followed by cyan ink during both the forward scan of FIG. 12A and backward scan of FIG. 12B, producing no color variations which would otherwise be caused by a difference in the ink ejection order.

Fourth Comparison Example

This comparison example represents a case where the same print head as used in the third embodiment is used and in which the print duties of cyan and magenta inks are each 100%, i.e., a secondary color is formed of these inks at a maximum gradation level. Images are formed by a 2-pass bidirectional printing, as in the preceding embodiment. Print duties DC, DM are both 50% (100/2%).

In this example, the nozzle lines C1, C2, M1, M2 are used evenly both in the forward and backward scans. So, the print duties of the nozzle lines C1, C2, M1, M2 are somewhat high in both the forward and backward scans.

Figures 13A, 13B:
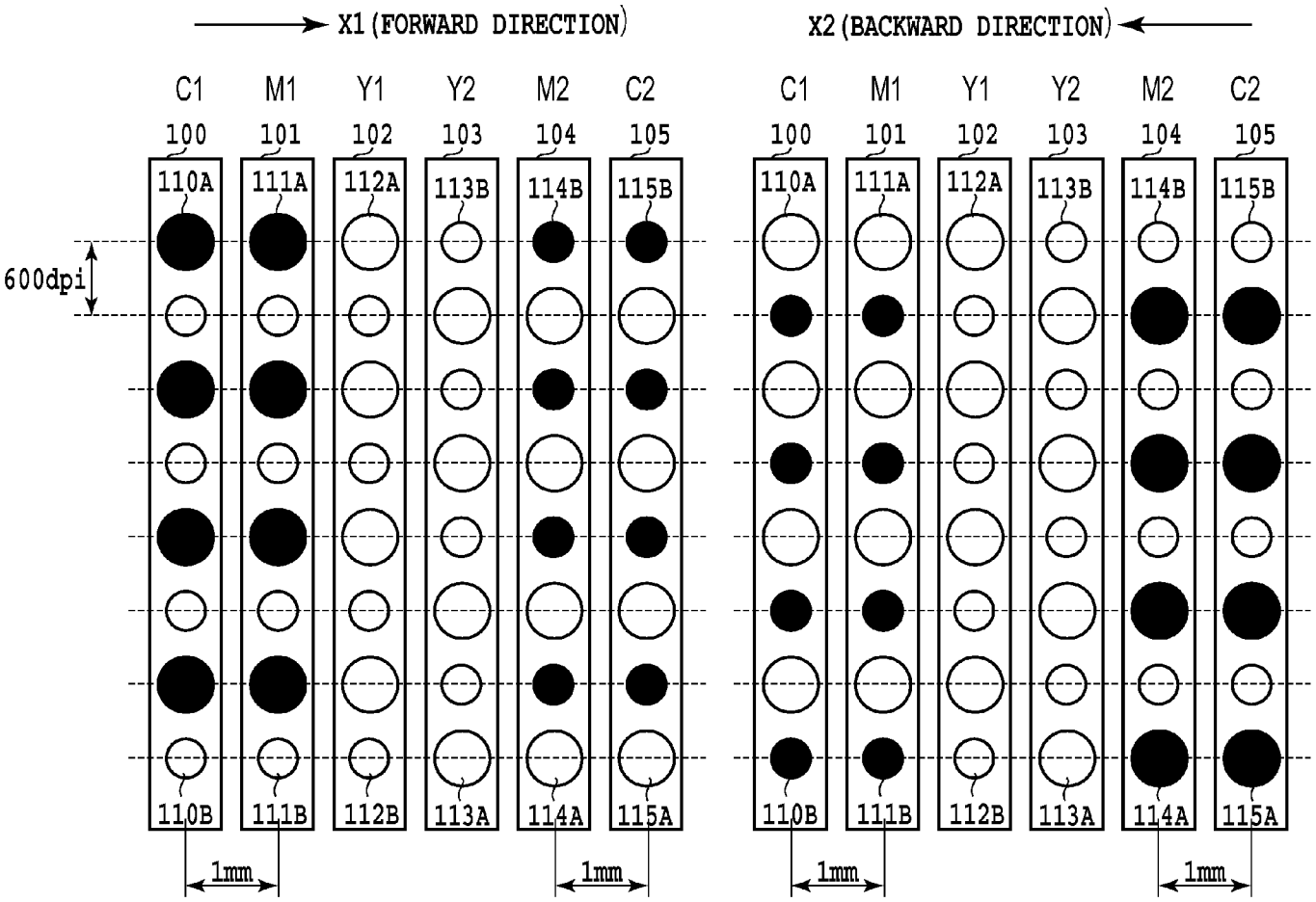
FIGS. 13A and 13B schematic diagrams showing a result of allocation of print data in a fourth comparison example.

During the forward scan, the print duties of the nozzle lines C1, C2, M1, M2 are somewhat high, as shown in FIG. 13A. Thus, there tends to be an increased depressurization near the ejection openings of these nozzle lines, forming wrapping air flows that rise from the print medium side, as shown in FIG. 19. Since the distance between the nozzle lines C1 and M1 and the distance between the nozzle lines C2 and M2 are as short as 1 mm, air flow escape paths are unlikely to be formed between the paired nozzle lines. As a result, satellites 12 ejected from these nozzle lines (see FIG. 3A to FIG. 3D) and mist formed by a part of the main droplet 11 bouncing from the print medium 8 may adhere in large quantities to the ejection face of the print head.

Similarly, during the backward scan as shown in FIG. 13B, the print duties of the nozzle lines C1, C2, M1, M2 are somewhat high. Therefore, satellites 12 ejected from these nozzle lines (see FIG. 3A to FIG. 3D) and mist formed by a part of the main droplet 11 bouncing from the print medium 8 may easily adhere in large quantities to the ejection face of the print head.

Figure 14:
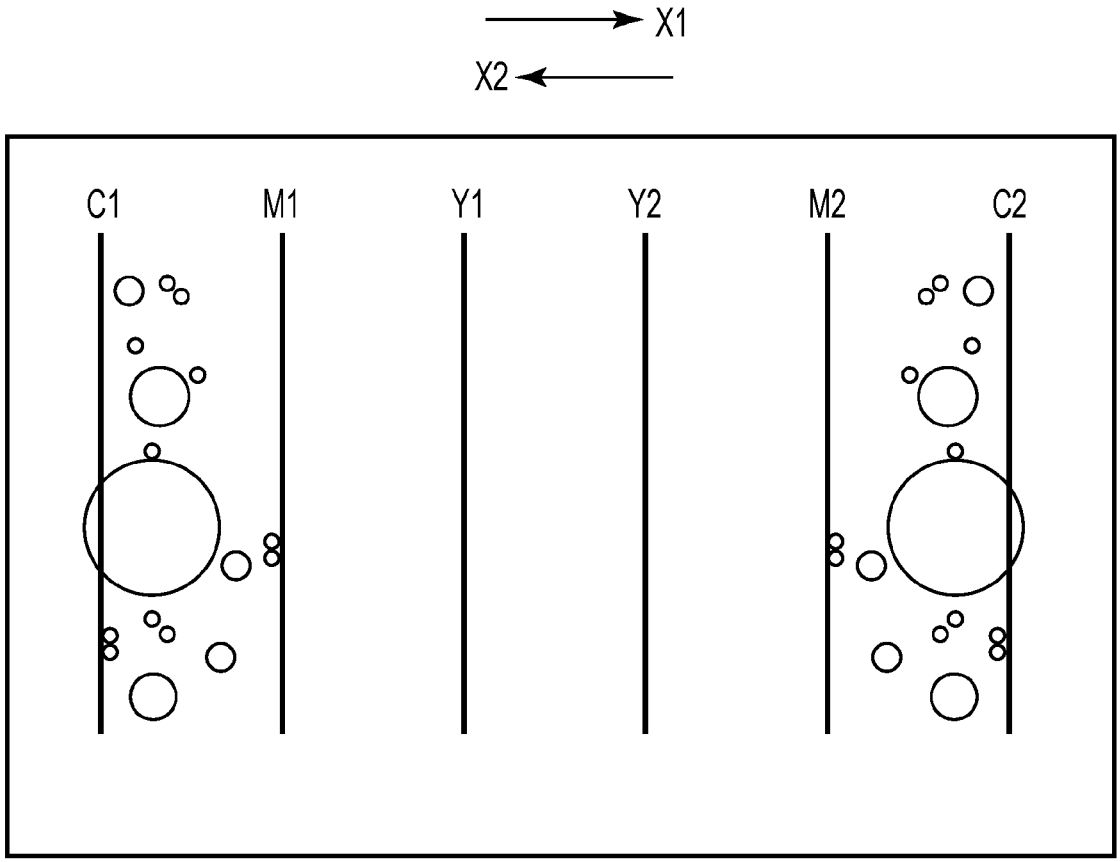
FIG. 14 is a schematic view showing a state of ink mist adhering to the print head in the fourth comparison example.

In this comparison example, a large quantity of mist and its aggregates are likely to adhere to the ejection face of the print head, as shown in FIG. 14, and clog the ejection openings causing ink ejection failures.

When forming a secondary color using magenta and yellow inks, if the print duties of the nozzle lines M1, M2, Y1, Y2 are set at 25% in both the forward and backward scans, as in this example, large quantities of mist may adhere to the ejection face of the print head, which in turn may cause ink ejection failures.

Fourth Embodiment

Figure 15B:
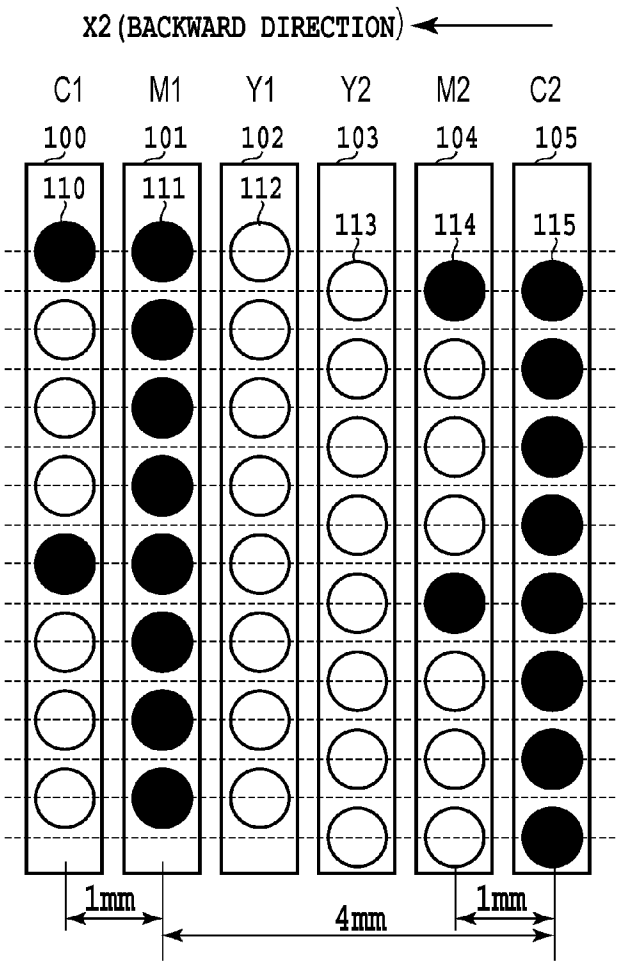
FIGS. 15A and 15B are schematic diagrams showing an example of control in a fourth embodiment of this invention.
Figure 15A:
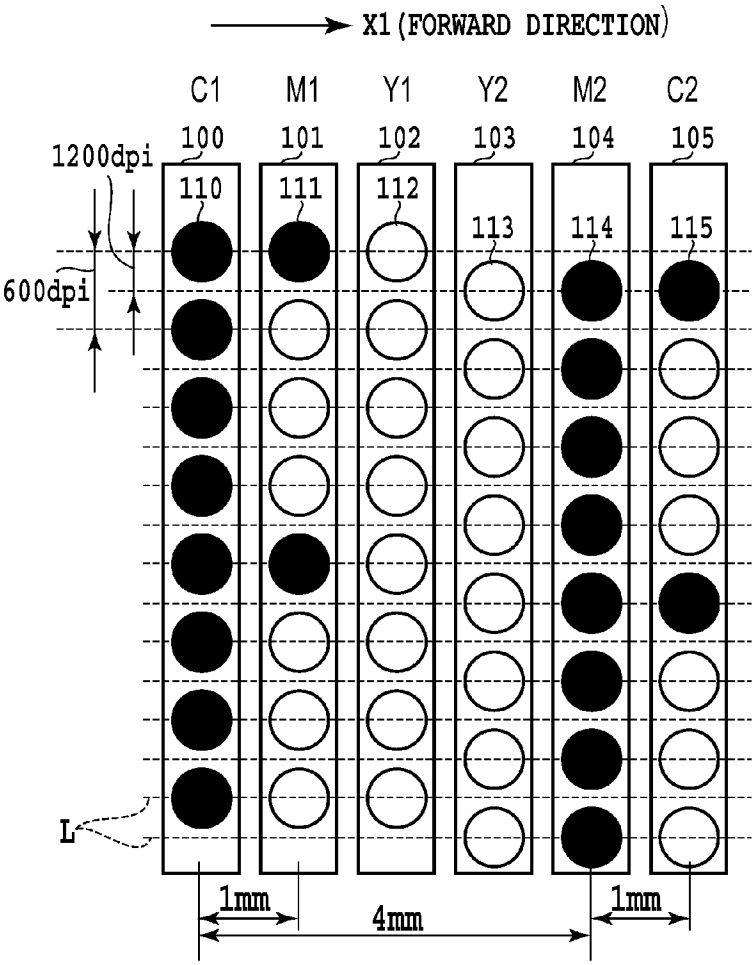

A print head of this embodiment has the same construction as that shown in FIG. 10A of the second embodiment. That is, nozzles in each nozzle line are arrayed at a pitch of 600 dpi, as shown in FIG. 15A. Nozzles of nozzle lines C1, M1, Y1 are shifted one-half pitch from those of nozzle lines C2, M2, Y2 in the subscan direction. As a result, the nozzle lines C1, C2 together provide a print density in the subscan direction of 1200 dpi. Similarly, the nozzle lines M1, M2 together provide a print density in the subscan direction of 1200 dpi. The nozzle lines Y1, Y2 also together provide a print density in the subscan direction of 1200 dpi. In FIG. 15A and FIG. 15B, only eight nozzles are representatively shown in each nozzle line.

In this example, a secondary color is printed by a 1-pass bidirectional printing that uses cyan and magenta inks. The 1-pass bidirectional printing completes an image in a predetermined print area by one scan in a forward direction (one forward scan) and one scan in a backward direction (one backward scan). FIG. 15A shows a nozzle activation state during the forward scan and FIG. 15B shows a nozzle activation state during the backward scan.

FIG. 15A and FIG. 15B represent a case where the print duties of cyan and magenta inks are each 125% and in which a secondary color image of these inks is printed by a 1-pass bidirectional printing. So, print duties DC, DM are both 125%.

In this example, during the forward scan the print duty of the nozzle lines C1, M2 are high and those of the nozzle lines M1, C2 low, as shown in FIG. 15A. Therefore, during the forward scan, near the ejection openings in the nozzle lines C1, M2 with high print duties, there tends to be an increased depressurization, forming wrapping air flows that rise from the print medium side, as shown in FIG. 19.

However, since the distance between the nozzles C1 and M2 is as large as 4 mm, air flow escape paths are formed. As to the nozzle lines M1, C2 that are located only 1 mm from the nozzle lines C1, M2 respectively, since their print duties are low, air flow escape paths are also formed near the ejection openings of these nozzles M1, C2. As a result, satellites 12 ejected from the nozzle lines C1, C2, M1, M2 (see FIG. 3A to FIG. 3D) and mist formed by a part of the main droplet 11 bouncing from the print medium 8 are less likely to adhere to the ejection face of the print head.

During a backward scan, on the other hand, the allocation ratios of data value between the nozzle lines C1 and C2 and between the nozzle lines M1 and M2 are reversed. That is, the print duties of the nozzle lines C1, M2 are low and those of the nozzle lines M1, C2 high, as shown in FIG. 15B. Therefore, during the backward scan, near the ejection openings in the nozzle lines C2, M1 with high print duties, there tends to be an increased depressurization which in turn forms wrapping air flows rising from the print medium, as shown in FIG. 19.

However, since the distance between these nozzle lines C2 and M1 is as large as 4 mm, air flow escape paths are formed between them. As to the nozzle lines M2, C1 located only 1 mm from the nozzle lines C2, M1, since their print duties are low, air flow escape paths are also formed near the ejection openings of the nozzle lines M2, C1. As a result, satellites 12 ejected from the nozzle lines C1, C2, M1, M2 (see FIG. 3A to FIG. 3D) and mist formed by a part of the main droplet 11 bouncing from the print medium 8 are less likely to adhere to the ejection face of the print head.

By allocating the data values as described above, the distance between the nozzle lines with high print duties can be so large to minimize the amount of mist adhering to the ejection face of the print head, as in the case of FIG. 20A and FIG. 20B. This in turn can reduce the possibility of ink ejection failure that would otherwise be caused by mist and its aggregates clogging the ejection openings.

Further, the ink ejection order of cyan and magenta inks remains the same during both the forward and backward scans of FIG. 15A and FIG. 15B, producing no color variations that would otherwise be caused by a difference in ink ejection order.

It is also possible to form a secondary color from cyan and magenta ink by using the nozzle lines of FIG. 15B during the forward scan and the nozzle lines of FIG. 15A during the backward scan, as opposed to the above.

Similarly, when forming a secondary color from magenta and yellow inks, it is possible to use the nozzle lines Y1, M2 during the forward scan and the nozzle lines Y2, M1 during the backward scan to minimize the amount of mist adhering to the ejection face of the print head, thereby preventing ink ejection failures. Conversely, it is also possible to use the nozzle lines Y2, M1 during the forward scan and the nozzle lines Y1, M2 during the backward scan.

Fifth Embodiment

Figure 16B:
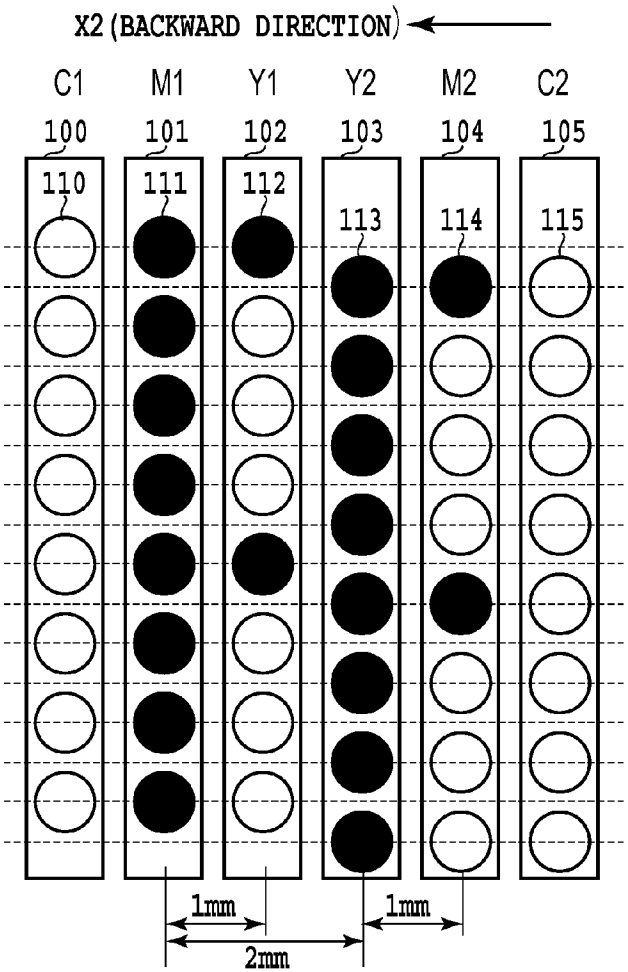
FIGS. 16A and 16B are schematic diagrams showing an example of control in a fifth embodiment of this invention.
Figure 16A:
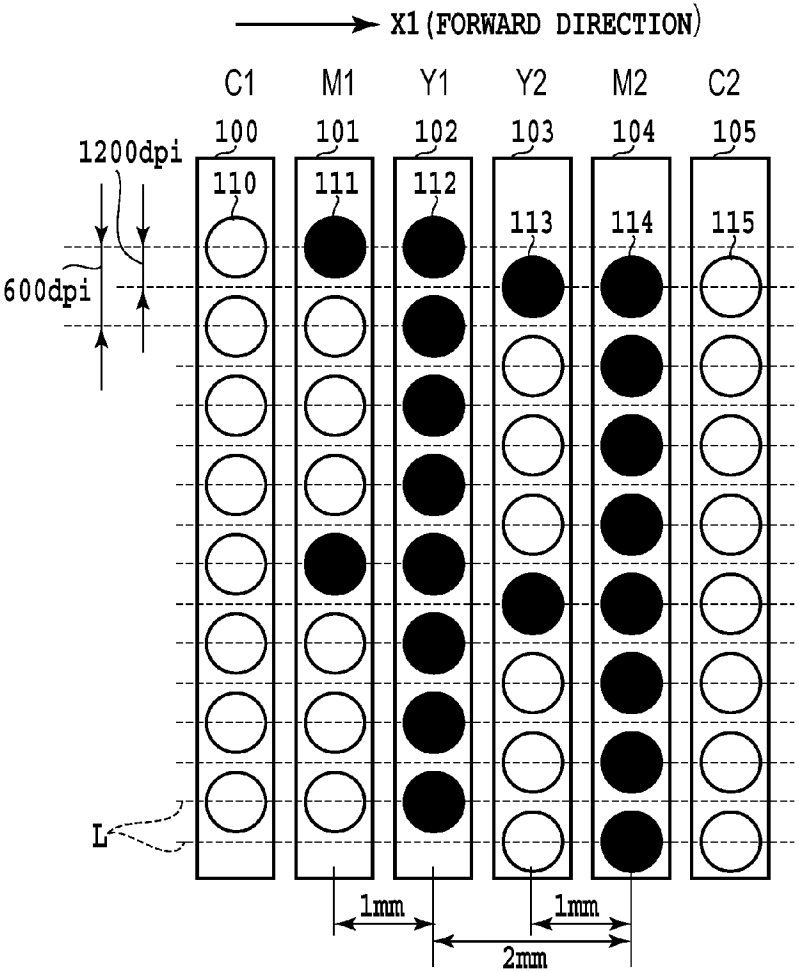

FIG. 16A and FIG. 16B represent a case where the same print head as used in the fourth embodiment is used to form a secondary color image of magenta and yellow inks by a 1-pass bidirectional printing. In this example, print duties of magenta and yellow inks are each 125%. So, print duties DM, DY are both 125%.

In this example, during the forward scan the print duties of the nozzle lines M1, Y2 are low and those of the nozzle lines y1, M2 are high. Therefore, during the forward scan, near the ejection openings of the nozzle lines Y1, M2 with high print duties, there tends to be an increased depressurization, forming wrapping air flows that rise from the print medium side, as shown in FIG. 19.

Figure 17:
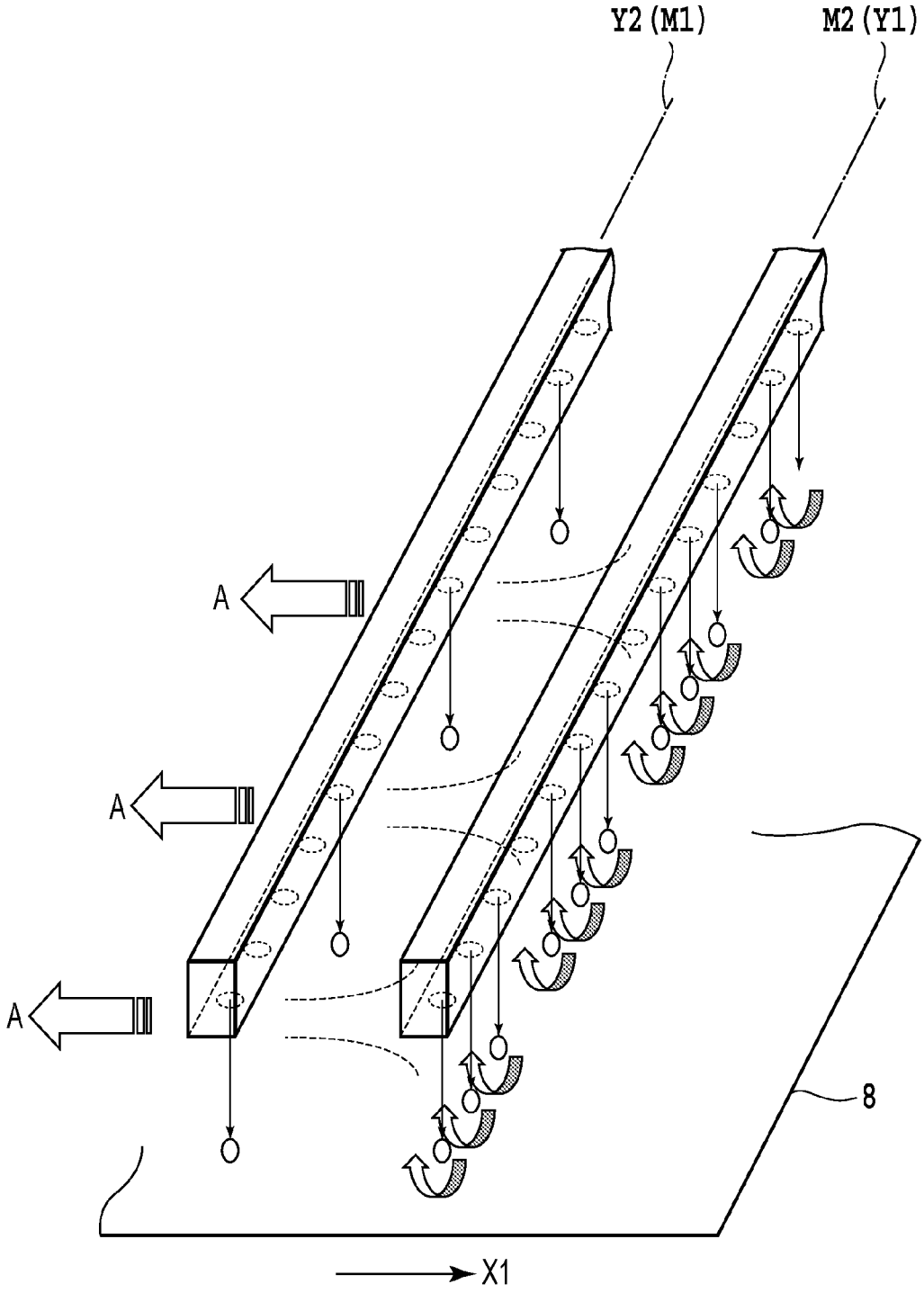
FIG. 17 illustrates paths through which air flows occurring during a forward scanning can escape in the fifth embodiment of this invention.

However, since the distance between these nozzle lines Y1 and M2 is as large as 2 mm, air flow escape paths are formed between them. As to the nozzle lines M1, Y2 located only 1 mm from the nozzle lines Y1, M2, since their print duties are low, air flow escape paths are also formed in a direction of arrow A near the ejection openings of the nozzle lines M1, Y2, as shown in FIG. 17. As a result, satellites 12 ejected from the nozzle lines M1, M2, Y1, Y2 (see FIG. 3A to FIG. 3D) and mist formed by a part of the main droplet 11 bouncing from the print medium 8 are less likely to adhere to the ejection face of the print head.

During the backward scan, on the other hand, the allocation ratios of data value between the nozzle lines M1 and M2 and between the nozzle lines Y1 and Y2 are reversed. That is, as shown in FIG. 16B, the print duties of the nozzle lines M1, Y2 are high and those of nozzle lines Y1, M2 are low. Therefore, during the backward scan, near the ejection openings in the nozzle lines M1, Y2 with high print duties, there tends to be an increased depressurization which in turn forms wrapping air flows rising from the print medium, as shown in FIG. 19.

Figure 18:
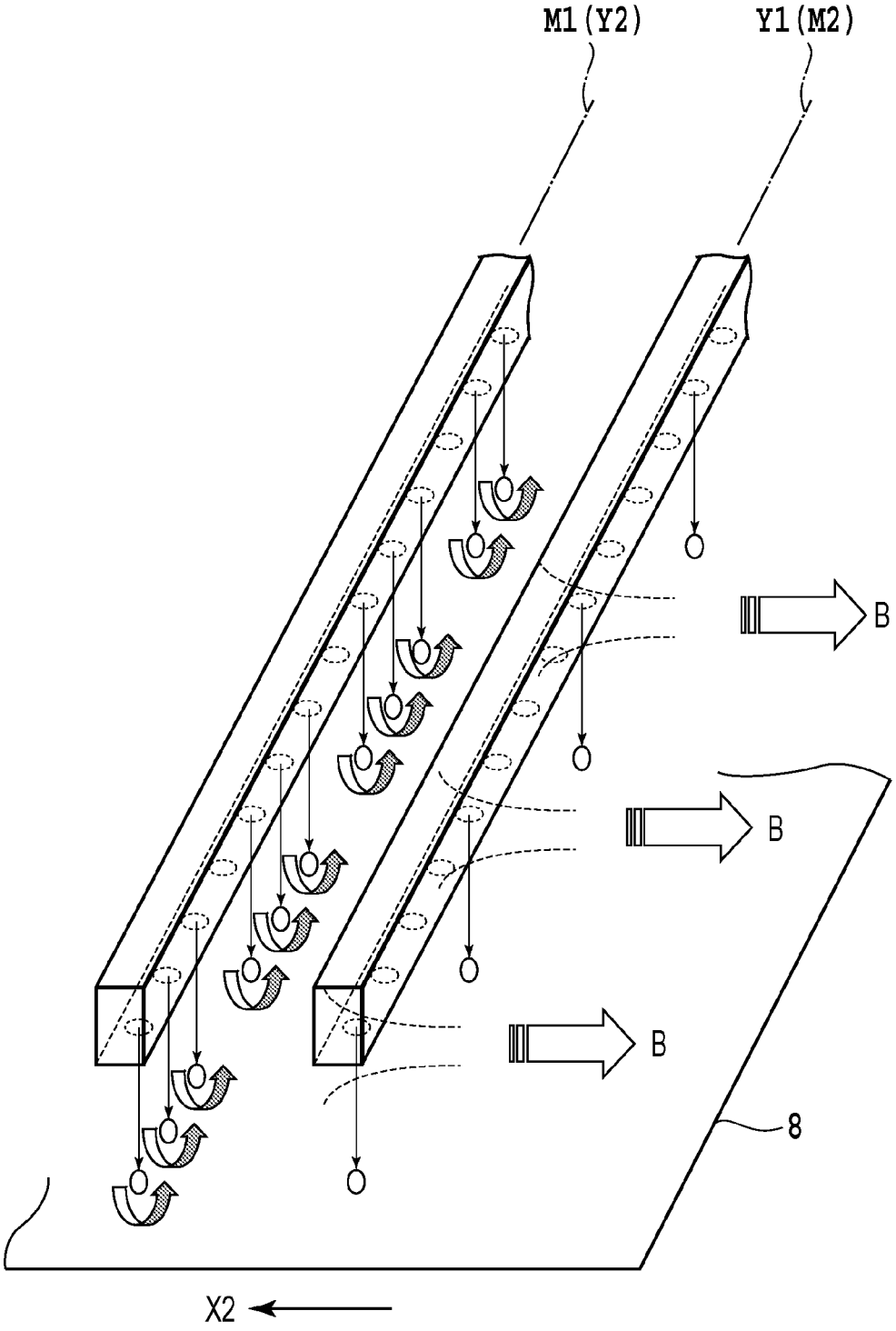
FIG. 18 illustrates paths through which air flows occurring during a backward scanning can escape in the fifth embodiment of this invention.

However, since the distance between these nozzle lines M1 and Y2 is as large as 2 mm, air flow escape paths are formed between them. As to the nozzle lines Y1, M2 located only 1 mm from the nozzle lines M1, Y2, since their print duties are low, air flow escape paths are also formed near the ejection openings of the nozzle lines Y1, M2, as shown in FIG. 18. As a result, satellites 12 ejected from the nozzle lines Y1, Y2, M1, M2 (see FIG. 3A to FIG. 3D) and mist formed by a part of the main droplet 11 bouncing from the print medium 8 are less likely to adhere to the ejection face of the print head.

By allocating the print duties as described above, the distance between the nozzle lines with high print duties can be so large to minimize the amount of mist adhering to the ejection face of the print head, as in the case of FIG. 20A and Fig. This in turn can reduce the possibility of ink ejection failure that would otherwise be caused by mist and its aggregates clogging the ejection openings.

Further, the ink ejection order of magenta and yellow inks remains the same during both the forward and backward scans of FIG. 16A and FIG. 16B, producing no color variations that would otherwise be caused by a difference in ink ejection order.

A secondary color from magenta and yellow inks may also be formed by using the nozzle lines of FIG. 16B during the forward scan and the nozzle lines of FIG. 16A during the backward scan, as opposed to the above.

Other Embodiments

The present invention can be applied to a wide range of ink jet printing apparatus of a so-called serial scan type. The printing apparatus need only be able to print an image on a print medium by moving a print head—which has a plurality of ink ejecting nozzle lines arranged side by side—in a main scan direction crossing the nozzle lines.

This invention needs only to be able to divide and allocate the multivalued data or the binary data to a plurality of nozzle lines for the same ink color at different allocation ratios and, based on the allocated data, eject ink from the print head. At least a part of these functions may be assigned to a host device connected to the printing apparatus.

This invention needs to be able to use different data allocation ratios according to the positions in the main scan direction of a plurality of nozzle lines so that the nozzle lines with high data allocation ratio do not concentrate in position in the main scan direction. Concentration of nozzle lines with high allocation ratio includes a case where nozzle lines with high allocation ratio are arranged at adjoining positions and a case where a percentage of those nozzle lines having high allocation ratio with respect to all nozzle lines arranged in a predetermined area is higher than a predetermined value. The only requirement is that air flow escape paths can be formed near the nozzle lines with high allocation ratio to minimize adverse effects of the air flows.

Further, since the data value (gradation value) of multivalued gradation data and the number of print dots of binary data are in a one-to-one relation, a print duty can be determined from the multivalued gradation data as a percentage of pixels printed with dots with respect to all pixels.

Inks to be ejected from a plurality of nozzle lines may be one and the same ink, or two or more different inks as in the preceding embodiments. In the latter case, for each ink there is provided a plurality of nozzle lines or a nozzle line group. At least one of these nozzle line groups may include a plurality of nozzle lines ejecting different ink volumes or at least one of a plurality of nozzle lines that are arranged shifted in nozzle pitch. The only requirement is that the data allocation ratios for a plurality of nozzle lines in each nozzle line group can be set to different ratios according to the positions in the main scan direction of the nozzle lines so that the nozzle lines with high allocation ratio in each group do not concentrate in position in the main scan direction.

These nozzle line groups may, for example, include a first nozzle line group comprising a first and a second nozzle line capable of ejecting a first ink and a second nozzle line group comprising a third and a fourth nozzle line capable of ejecting a second ink. In the preceding embodiments, two of cyan, magenta and yellow inks correspond to the first and second ink. Of a group of nozzle lines C1, C2, a group of nozzle lines M1, M2 and a group of nozzle lines Y1, Y2, two groups correspond to the first and second nozzle line group.

In that case, the multivalued data for first ink ejection is allocated to the first and second nozzle lines and the multivalued data for second ink ejection is allocated to the third and fourth nozzle lines. For example, the allocation ratio between the first and second nozzle lines is changed and the allocation ratio between the third and fourth nozzle lines is also changed so that one of the first and second nozzle lines with high allocation ratio and one of the third and fourth nozzle lines with high allocation ratio do not adjoin each other. More specifically, where one of the first and second nozzle lines adjoins one of the third and fourth nozzle lines, the allocation ratio for one of the first and second nozzle lines and/or the allocation ratio for one of the third and fourth nozzle lines needs to be lowered.

Where an image is printed in a bidirectional print mode by scanning the print head in a forward and a backward direction, the allocation ratio between the nozzle lines is changed according to the direction of scan. In this case, when the print head is moved along the scan direction, it is desired that the first, second, third and fourth nozzle line be arrayed so that the ejection order of the first and second ink from these nozzle lines remains the same in both the forward and backward directions. For example, when one of the first and second nozzle lines adjoins one of the third and fourth nozzle lines, the allocation ratio between the first and second nozzle line is reversed and the allocation ratio between the third and fourth nozzle line are also reversed according to the scan direction of the print head. That is, when the print head scans in one direction, the allocation ratio of one of the first and second nozzle lines is set high and the allocation ratio of the other set low; and the allocation ratio of one of the third and fourth nozzle lines is set low and the allocation ratio of the other set high. When the print head scans in the opposite direction, the allocation ratio of one of the first and second nozzle lines is set low and the allocation ratio of the other set high; and the allocation ratio of one of the third and fourth nozzle lines is set high and the allocation ratio of the other set low.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-322574, filed Dec. 13, 2007, which is hereby incorporated by reference herein in its entirety.

What is claimed is:

1. An ink jet printing apparatus that prints an image on a print medium, comprising:

a print head that includes first nozzles, second nozzles, third nozzles, and fourth nozzles, wherein (a) the first nozzles form a first nozzle array and are arrayed in a predetermined direction for ejecting a first ink, (b) the second nozzles form a second nozzle array and are arrayed in the predetermined direction for ejecting the first ink, (c) the third nozzles form a third nozzle array, which is disposed between the first nozzle array and the second nozzle array, and the third nozzles are arrayed in the predetermined direction for ejecting a second ink, which is different from the first ink in color, and (d) the fourth nozzles form a fourth nozzle array, which is disposed between the first nozzle array and the third nozzle array, and the fourth nozzles are arrayed in the predetermined direction for ejecting the second ink;

a scanning unit that executes a relative scan of the print head and the print medium in a first direction crossing the predetermined direction;

a setting unit that sets allocation ratios of an ejection of ink for each nozzle array, such that (a) an allocation ratio for the first nozzle array is higher than an allocation ratio for the second nozzle array, and an allocation ratio for the third nozzle array is higher than an allocation ratio for the fourth nozzle array, for a same scan by the scanning unit, or (b) the allocation ratio for the second nozzle array is higher than the allocation ratio for the first nozzle array, and the allocation ratio for the fourth nozzle array is higher than the allocation ratio for the third nozzle array, for the same scan by the scanning unit; and a control unit that controls ink ejection from the print head in accordance with the allocation ratios set by the setting unit.

2. The ink jet printing apparatus according to claim 1, further comprising:

a conveying unit that conveys the print medium in a second direction crossing the first direction.

3. The ink jet printing apparatus according to claim 1, wherein the setting unit is configured to change, at predetermined points, a printing state in which (a) the allocation ratio for the first nozzle array is higher than the allocation ratio for the second nozzle array, and the allocation ratio for the third nozzle array is higher than the allocation ratio for the fourth nozzle array, to a printing state in which (b) the allocation ratio for the second nozzle array is higher than the allocation ratio for the first nozzle array and the allocation ratio for the fourth nozzle array is higher than the allocation ratio for the third nozzle array.

4. The ink jet printing apparatus according to claim 1, wherein the scanning unit executes the relative scan of the print head and the print medium, while ejecting ink, in one direction which is along the first direction and an opposite direction which is opposite to the one direction, and wherein when the relative scan of the print head and the print medium is in the one direction to print the image, the setting unit sets the allocation ratios for each nozzle array such that (a) the allocation ratio for the first nozzle array is higher than the allocation ratio for the second nozzle array, and the allocation ratio for the third nozzle array is higher than the allocation ratio for the fourth nozzle array, and when the relative scan of the print head and the print medium is in the opposite direction to print the image, the setting unit sets the allocation ratios for each nozzle array such that (b) the allocation ratio for the second nozzle array is higher than the allocation ratio for the first nozzle array, and the allocation ratio for the fourth nozzle array is higher than the allocation ratio for the third nozzle array.

5. The ink jet printing apparatus according to claim 1, wherein the print head prints the image on a same image area on the print medium by a plurality of scans.

6. The ink jet printing apparatus according to claim 2, wherein the conveying unit conveys, in a time between a scan and a next scan, the print medium by a predetermined length which is shorter than a length of the first, second, third, or fourth nozzle arrays in the predetermined direction.

7. The ink jet printing apparatus according to claim 1, wherein the setting unit sets the allocation ratios for each nozzle array according to a table defining data allocation ratios for allocating data to each of the nozzle arrays to print the image.

8. The ink jet printing apparatus according to claim 1, wherein the setting unit sets the allocation ratios for each nozzle array according to a pattern that defines positions of dots to be printed.

9. An ink jet printing method of printing an image on a print medium by ejecting ink from a print head that includes first nozzles, second nozzles, third nozzles, and fourth nozzles, wherein (a) the first nozzles form a first nozzle array and are arrayed in a predetermined direction for ejecting a first ink, (b) the second nozzles form a second nozzle array and are arrayed in the predetermined direction for ejecting the first ink, (c) the third nozzles form a third nozzle array, which is disposed between the first nozzle array and the second nozzle array, and the third nozzles are arrayed in the predetermined direction for ejecting a second ink, which is different from the first ink in color, and (d) the fourth nozzles form a fourth nozzle array, which is disposed between the first nozzle array and the third nozzle array, and the fourth nozzles are arrayed in the predetermined direction for ejecting the second ink, the ink jet printing method comprising:

a scanning step of executing a relative scan of the print head and the print medium in a first direction crossing the predetermined direction;

a setting step of setting allocation ratios of an ejection of ink for each nozzle array, such that (a) allocation ratio for the first nozzle array is higher than the allocation ratio for the second nozzle array, and an allocation ratio for the third nozzle array is higher than an allocation ratio for the fourth nozzle array for a same relative scan, or (b) the allocation ratio for the second nozzle array is higher than the allocation ratio for the first nozzle array, and the allocation ratio for the fourth nozzle array is higher than the allocation ratio for the third nozzle array for the same relative scan; and a control step of controlling ink ejection from the print head in accordance with the allocation ratios set in the setting step.

10. The ink jet printing method according to claim 9, further comprising:

a conveying step of conveying the print medium in a second direction crossing the first direction.

11. The ink jet printing method according to claim 9, further comprising:

a changing step of changing, at predetermined points, a printing state in which (a) the allocation ratio for the first nozzle array is higher than the allocation ratio for the second nozzle array, and the allocation ratio for the third nozzle array is higher than the allocation ratio for the fourth nozzle array, to a printing state in which (b) the allocation ratio for the second nozzle array is higher than the allocation ratio for the first nozzle array, and the allocation ratio for the fourth nozzle array is higher than the allocation ratio for the third nozzle array.

12. The ink jet printing method according to claim 9, wherein the relative scan of the print head and the print medium, while ejecting ink, is in one direction which is along the first direction and an opposite direction which is opposite to the one direction, and wherein when the relative scan of the print head and the print medium is in the one direction to print the image, the setting step sets the allocation ratios for each nozzle array such that (a) the allocation ratio for the first nozzle array is higher than the allocation ratio for the second nozzle array, and the allocation ratio for the third nozzle array is higher than the allocation ratio for the fourth nozzle array, and when the relative scan of the print head and the print medium is in the opposite direction to print the image, the setting step sets the allocation ratios for each nozzle array such that (b) the allocation ratio for the second nozzle array is higher than the allocation ratio for the first nozzle array, and the allocation ratio for the fourth nozzle array is higher than the allocation ratio for the third nozzle array.

13. The ink jet printing method according to claim 9, wherein the print head prints the image on a same image area on the print medium by a plurality of scans.

14. The ink jet printing method according to claim 10, wherein the print medium is conveyed in the conveying step, in a time between a scan and a next scan, by a predetermined length which is shorter than a length of the first, second, third, or fourth nozzle arrays in the predetermined direction.

15. The ink jet printing method according to claim 9, wherein the allocation ratios for each nozzle array are set in the setting step according to a table defining data allocation ratios for allocating data to each of the nozzle arrays to print the image.

16. The ink jet printing method according to claim 9, wherein the allocation ratios for each nozzle array are set in the setting step according to a pattern that defines positions of dots to be printed.

17. A data processing apparatus for generating print data which is used for printing an image on a print medium by ejecting ink from a print head that includes first nozzles, second nozzles, third nozzles, and fourth nozzles, while relatively scanning the print head and the print medium in a first direction, wherein (a) the first nozzles form a first nozzle array and are arrayed in a predetermined direction crossing the first direction for ejecting a first ink, (b) the second nozzles form a second nozzle array and are arrayed in the predetermined direction for ejecting the first ink, (c) the third nozzles form a third nozzle array, which is disposed between the first nozzle array and the second nozzle array, and the third nozzles are arrayed in the predetermined direction for ejecting a second ink, which is different from the first ink in color, and (d) the fourth nozzles form a fourth nozzle array, which is disposed between the first nozzle array and the third nozzle array, and the fourth nozzles are arrayed in the predetermined direction for ejecting the second ink, the data processing apparatus comprising:

a setting unit that sets, for printing the image, allocation ratios of an ejection of ink for each nozzle array such that (a) an allocation ratio for the first nozzle array is higher than an allocation ratio for the second nozzle array, and an allocation ratio for the third nozzle array is higher than an allocation ratio for the fourth nozzle array, for a same scan by the scanning unit, or (b) the allocation ratio for the second nozzle array is higher than the allocation ratio for the first nozzle array, and the allocation ratio for the fourth nozzle array is higher than the allocation ratio for the third nozzle array, for the same scan by the scanning unit; and a generation unit that generates the print data in accordance with the allocation ratios set by the setting unit.

18. The data processing apparatus according to claim 17, wherein the setting unit is configured to change, at predetermined points, a printing state in which (a) the allocation ratio for the first nozzle array is higher than the allocation ratio for the second nozzle array, and the allocation ratio for the third nozzle array is higher than the allocation ratio for the fourth nozzle array, to a printing state in which (b) the allocation ratio for the second nozzle array is higher than the allocation ratio for the first nozzle array, and the allocation ratio for the fourth nozzle array is higher than the allocation ratio for the third nozzle array.

19. The data processing apparatus according to claim 17, wherein the generating unit is further configured to generate the print data, which is used for printing the image on the print medium by relatively scanning the print head and the print medium, while ejecting ink, in one direction which is along the first direction and an opposite direction which is opposite to the one direction, such that the print data reflects that when the relative scan of the print head and the print medium is in the one direction to print the image, the allocation ratios for each nozzle array is such that (a) the allocation ratio for the first nozzle array is higher than the allocation ratio for the second nozzle array, and the allocation ratio for the third nozzle array is higher than the allocation ratio for the fourth nozzle array, and when the relative scan of the print head and the print medium is in the opposite direction to print the image, the allocation ratios for each nozzle array is such that (b) the allocation ratio for the second nozzle array is higher than the allocation ratio for the first nozzle array, and the allocation ratio for the fourth nozzle array is higher than the allocation ratio for the third nozzle array.

* * * * *